US007918198B2

(12) United States Patent
Toma et al.

(10) Patent No.: US 7,918,198 B2
(45) Date of Patent: Apr. 5, 2011

(54) VALVE TIMING CONTROL DEVICE

(75) Inventors: Naoto Toma, Kariya (JP); Shigemitsu Suzuki, Takahama (JP); Hiroki Mukaide, Kariya (JP); Yasutaka Miura, Anjo (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 252 days.

(21) Appl. No.: 12/408,207

(22) Filed: Mar. 20, 2009

(65) Prior Publication Data

US 2009/0288625 A1 Nov. 26, 2009

(30) Foreign Application Priority Data

May 20, 2008 (JP) ..... 2008-132233
Jul. 9, 2008 (JP) ..... 2008-179319

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 7,363,898 B2 4/2008 Suzuki et al.
7,444,964 B2 * 11/2008 Kanada et al. ..... 123/90.15

* cited by examiner

*Primary Examiner* — Ching Chang
(74) *Attorney, Agent, or Firm* — Buchanan Ingersoll & Rooney PC

(57) ABSTRACT

A valve timing control device includes a phase displacement restricting mechanism for creating a restricting state where relative rotational phase displacement of a driven side rotational member relative to a driving side rotational member is restricted within a permissible range and an unrestricting state where the restriction is released, a communication passageway for establishing communication between the phase displacement restricting mechanism and one of an advanced angle chamber and a retarded angle chamber, a valving element chamber provided midway the communication passageway, a valving element provided in the valving element chamber; the valving element selectively positioned to a closing state for closing the communication passageway to render the phase displacement restricting mechanism into the restricting state and an opening state for opening up the communication passageway to render the phase displacement restricting mechanism into the unrestricting state, and a leak passageway formed in the valving element and configured to allow leakage of fluid from an intermediate passage to the outside when the valving element is under the closing state.

9 Claims, 18 Drawing Sheets

VALVE TIMING CONTROL DEVICE

CROSS REFERENCE TO RELATED APPLICATIONS

This application is based on and claims priority under 35 U.S.C. Section 119 to Japanese Patent Application Nos. 2008-132233 and 2008-179319, filed on May 20, 2008 and Jul. 9, 2008, respectively, the entire contents of which are incorporated herein by reference.

FIELD OF THE INVENTION

This invention generally relates a valve timing control device.

BACKGROUND

U.S. Pat. No. 7,363,898 discloses a valve timing control device configured to start an engine, with a driving side rotational member and a driven side rotational member being interlocked. According to U.S. Pat. No. 7,363,898, the valve timing control device includes a locking member and an engaging recess portion provided between/across the driving side rotational member and the driven side rotational member. And, when the engine is stopped, a spring member brings the locking member and the engaging recess portion into engagement with each other in response to discharge of operational oil of the valve timing control device.

For enabling this engagement between the locking member and the engaging recess portion, it is required that the driving side rotational member and the driven side rotational member be in alignment with each other at a predetermined position. For this reason, in the case of the valve timing control device disclosed in U.S. Pat. No. 7,363,898, there is provided a phase displacement restricting mechanism for restricting relative rotation between the locking member and the engaging recess portion within a predetermined angular range, thereby to restrict the relative positions between the locking member and the engagement recess portion within a predetermined range.

This phase displacement restricting mechanism includes an projecting/retracting member ("insertion member") provided in the driven side rotational member and a recess portion provided in the driving side rotational member and capable of retaining the projecting/retracting member. The projecting/retracting member is projected or retracted by operational oil fed into an advanced angle chamber of the valve timing control device, at the time of startup of the engine. In other words, the projecting/retracting member functions to maintain the driving side rotational member and the driven side rotational member under the interlocked state until the operational oil pressure of the valve timing control device builds up at the time of start of the engine. Once the engine has started, the operational oil releases the projecting/retracting member and the locking state by the locking member. With this, the driving side rotational member and the driven side rotational member become rotatable relative to each other and the relative phase between these two rotational members is appropriately controlled through control using the operational oil.

Incidentally, desirably, the retracting movement of the projecting/retracting member should occur under the state of the operational oil being fed to both the advanced angle chamber and the retarded angle chamber at the time of the engine startup. For, if the projecting/retracting member is retracted to release the interlocked state when the operational oil is not fed to both the advanced angle chamber and the retarded angle chamber, the relative phase between the two rotational members cannot be retained, thus leading to deterioration in the engine startup performance. For this reason, the valve timing control device is provided with a valving element operable by operational oil fed thereto. The projecting/retracting member becomes movable after this valving element is activated.

However, at the time of stopping the engine, failure, if occurs, in the collaboration between the projecting/retracting member and the valving element could result in impossibility of fixing the driving side rotational member and the driven side rotational member under the interlocked state. For example, at the time of start of engine, by the operational oil fed to the retarded angle chamber, first, the valving element is changed in position to its start position, whereby communication is established between the advanced angle chamber and the projecting/retracting member, so that the oil from the advanced angle chamber causes the projecting/retracting member to be changed in position to the engagement releasing position. When the engine is stopped, these series of collaborative operations are carried out in reverse order. That is, in response to stopping of the engine, the operational oil is drained from the advanced angle chamber and the retarded angle chamber, so that the oil pressure drops. In response to this, first, the projecting/retracting member is moved to the retaining position and then the valving element is moved to its initial position.

However, due to an unexpected cause, the movement of the valving element may precede the movement of the projecting/retracting member. In this case, the communication between the driving side rotational member and the driven side rotational member will be blocked by the valving element, so that the projecting/retracting member becomes unable to protrude, thus failing to fix the driving side rotational member and the driven side rotational member to the interlocking phase. As a result, the next startup of the engine will become difficult.

Thus, a need exists for a valve timing control device having a phase displacement restricting mechanism which is not susceptible to the drawback mentioned above.

SUMMARY OF THE INVENTION

According to one aspect of the present invention, there is proposed a valve timing control device comprising:

a driving side rotational member synchronously rotatable with a crankshaft of an internal combustion engine;

a driven side rotational member coaxial with said driving side rotational member and synchronously rotatable with a valve opening/closing cam shaft of the internal combustion engine;

a fluid pressure chamber formed in one of said driving side rotational member and said driven side rotational member;

a partitioning portion provided in the other of said driving side rotational member and said driven side rotational member for partitioning said fluid pressure chamber into an advanced angle chamber and a retarded angle chamber;

a fluid feeding/discharging mechanism for feeding/discharging fluid to/from said advanced angle chamber and said retarded angle chamber;

a phase displacement restricting mechanism for creating a restricting state where relative rotational phase displacement of said driven side rotational member relative to said driving side rotational member is restricted within a permissible range and an unrestricting state where the restriction is released;

a communication passageway for establishing communication between said phase displacement restricting mechanism and a valve timing adjusting chamber which is one of said advanced angle chamber and said retarded angle chamber;

a valving element chamber provided in said communication passageway;

a valving element provided in said valving element chamber, said valving element selectively positioned to a closing state for closing said communication passageway to render said phase displacement restricting mechanism into said restricting state and an opening state for opening up said communication passageway to render said phase displacement restricting mechanism into said unrestricting state; and a leak passageway formed in at least one of said valving element and said valving element chamber and configured to allow leakage of fluid from an intermediate passage to the outside when said valving element is under the closing state, said intermediate passage comprising a space which is located between said communicated valve timing adjusting chamber or said phase displacement restricting mechanism and said valving element and which constitutes a portion of said communication passageway.

With the above construction, even when the valving element is under the closing state, the fluid can leak to the outside through the leak passageway. For instance, when the internal combustion engine is stopped, even if the valving element returns faster than the phase displacement restricting mechanism, any fluid dwelling in the intermediate passage may leak to the outside through the leak passageway. Therefore, the phase displacement restricting mechanism can readily return to the restricting state.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

First Embodiment

Next, there will be described, with reference to the accompanying drawings, an embodiment in which a valving timing control device relating to the present invention is applied to an automobile engine as an internal combustion engine.

(Basic Construction of Valve Timing Control Device)

Figure 1:
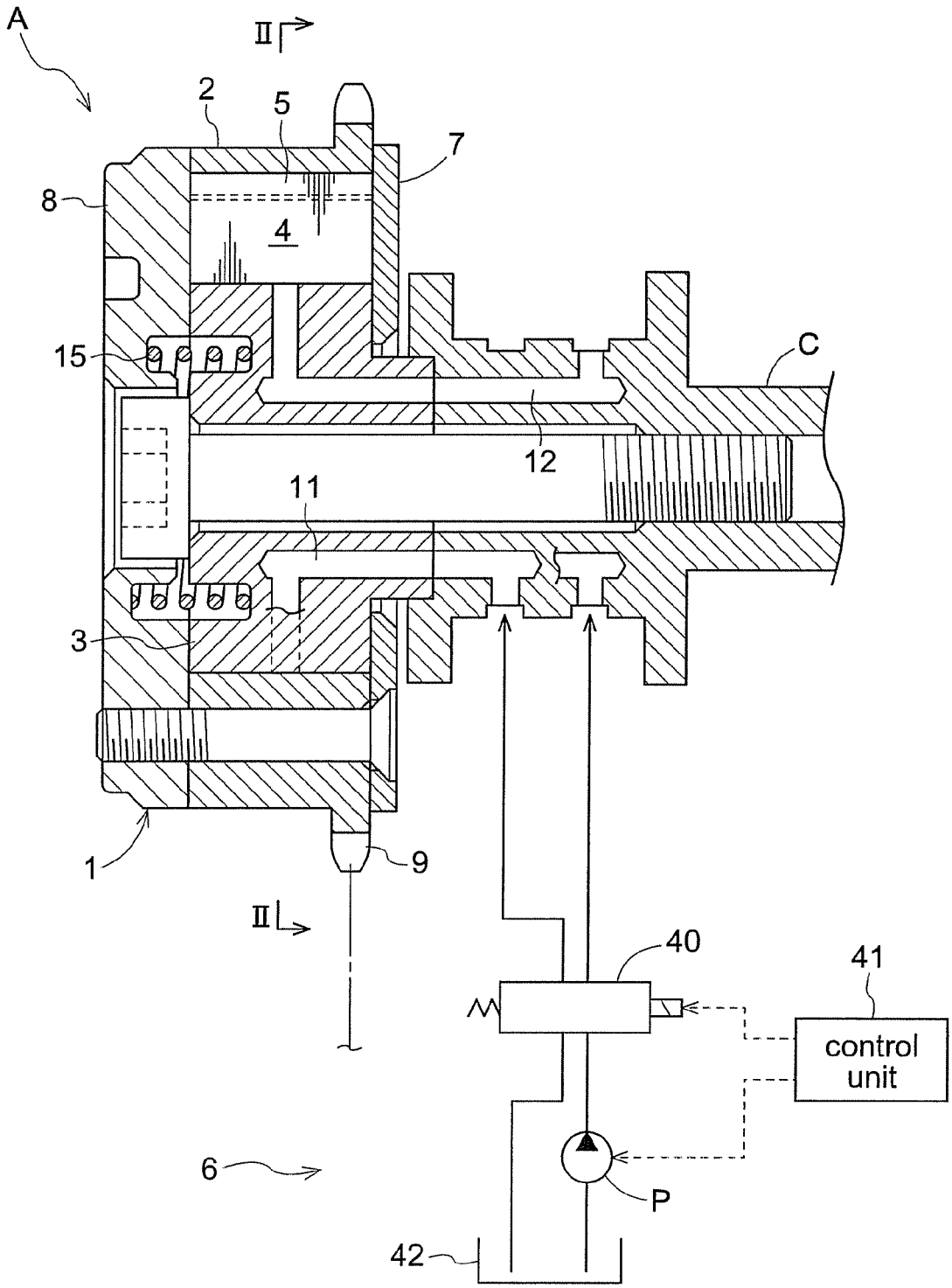
FIG. 1 is a side view in section of a valve timing control device.
Figure 2:
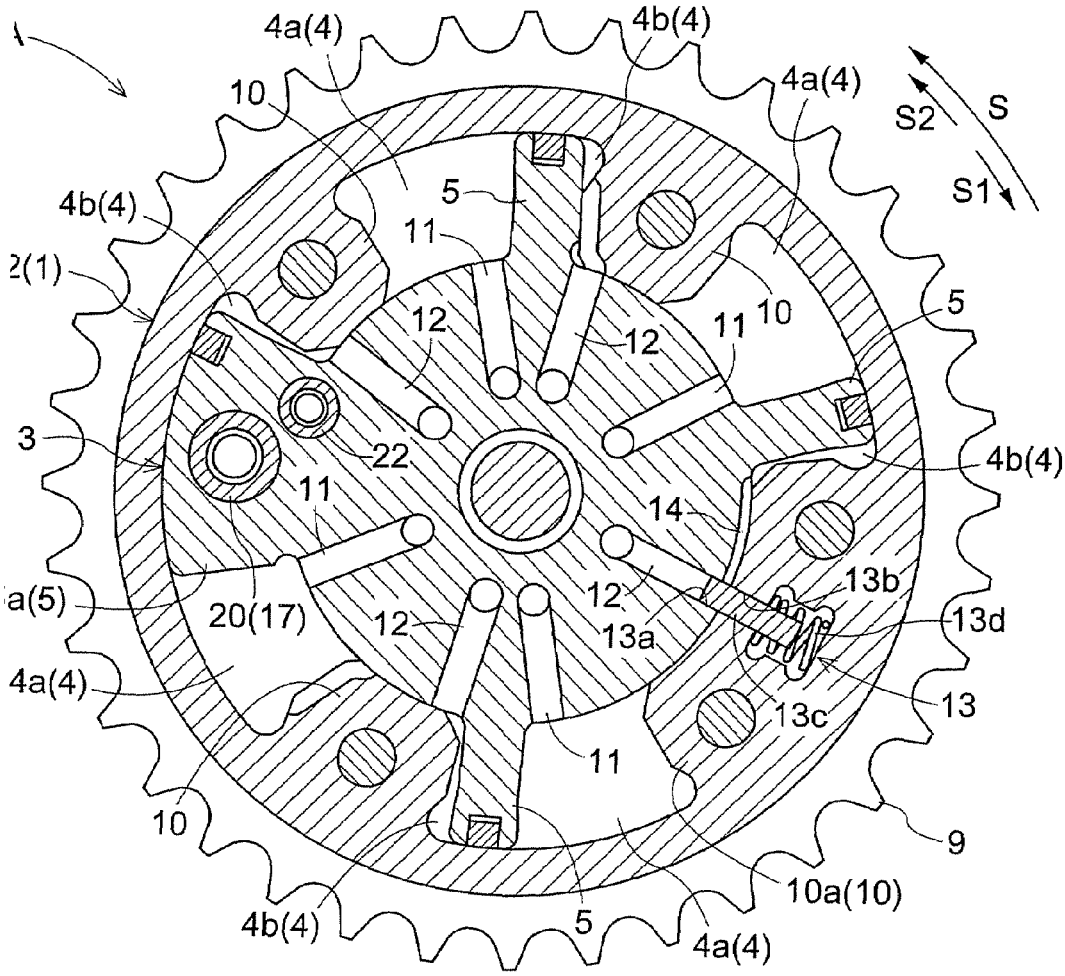
FIG. 2 is a section taken along II-II in FIG. 1.

As shown in FIG. 1 and FIG. 2, a valve timing control device A includes an outer rotor 1 synchronously rotatable with an unillustrated crankshaft of an engine as an internal combustion engine, and an inner rotor 3 coaxial with the outer rotor 1 and synchronously rotatable with a valving opening/closing cam shaft C of the engine. Here, the outer rotor 1 corresponds to a "driving side rotational member" defined in the present invention and the inner rotor 3 corresponds to a "drive side rotational member" defined in the present invention. The valve timing control device A includes a plurality of fluid pressure chambers 4 formed in the outer rotor 1 and a plurality of partitioning portions 5, each partitioning portion 5 partitioning each fluid pressure chamber 4 into two valve timing adjusting chambers, namely, an advanced angle chamber 4*a* and a retarded angle chamber 4*b*. The partitioning portions 5 are provided in the inner rotor 3. Further, the valve timing control device A includes a hydraulic circuit 6 acting as a "fluid feeding/discharging mechanism" for feeding/discharging operational oil as fluid, to/from the advanced angle chamber 4*a* and the retarded angle chamber 4*b*.

(Construction of Hydraulic Circuit)

As shown in FIG. 1, the hydraulic circuit 6 includes a pump P driven by the engine for feeding the operational oil (fluid), and a control valve 40 for controlling feeding/discharging of the operational oil to/from the fluid pressure chambers 4. The hydraulic circuit 6 further includes a control unit 41 for controlling operations of the pump P and the control valve 40. The pump P draws in the operational oil reserved in an oil pan 42 and feeds this operational oil to one or both of advanced angle passageway 11 and retarded angle passageway 12.

The inner rotor 3 is assembled integrally to a leading end portion of an exhausting side cam shaft C which constitutes a rotational shaft of an unillustrated cam for controlling opening/closing of an exhaust valve of the engine. This cam shaft C is rotatably assembled with an unillustrated cylinder head of the engine. On the outer side of the inner rotor 3, the outer rotor 1 is mounted. The outer rotor 1 includes a rear plate 7 to which the cam shaft C is connected, a front plate 8 opposite thereto and a cylindrical body 2 interconnecting the rear plate 7 and the front plate 8. On the outer periphery of the outer rotor 1, a timing sprocket 9 is formed. Between and across this timing sprocket 9 and an unillustrated gear mounted on the crankshaft of the engine, there is provided an unillustrated force transmitting member such as a timing chain, a timing belt, etc.

As shown in FIG. 2, the outer rotor 1 includes a plurality of projecting portions 10 projecting along the radial direction, with the projecting portions 10 being provided in juxtaposition along the rotational direction. And, between respective adjacent pairs of projecting portions 10 adjacent along the peripheral direction (rotational direction S) of the outer rotor 1, the fluid pressure chambers 4 are formed. In the instant embodiment, four fluid pressure chambers 4 are formed. Along the outer peripheral portion of the inner rotor 3 opposed to the respective fluid pressure chambers 4, the plurality of partitioning portions 5 are formed along the radial direction, each partitioning member 5 partitioning each fluid pressure chamber 4 into the advanced angle chamber 4*a* and the retarded angle chamber 4*b* along the peripheral direction.

As shown in FIG. 1 and FIG. 2, the inner rotor 3 defines the advanced angle passageways 11 and the retarded angle passageways 12 along the axial direction of the rotational axis. Each advanced angle passageway 11 is communicated with the advanced angle chamber 4*a* corresponding thereto and each retarded angle passageway 12 is communicated with the retarded angle chamber 4*b* corresponding thereto and also an engaging recess 13*a* of a locking mechanism 13 to be described later. The advanced angle passageways 11 and the retarded angle passageways 14 are connected to the hydraulic circuit 6. Further, the inner rotor 3 forms a communication groove 14 for establishing communication between a retarded angle chamber 4*b* located adjacent the locking mechanism 13 and the engaging recess 13 defined in this locking mechanism 13.

In operation, as the operational oil as fluid is supplied to or discharged from one or both of the advanced angle chamber 4*a* and the retarded angle chamber 4*b*, the relative rotational phase of the inner rotor 3 relative to the outer rotor 1 is displaced. In FIG. 2, the direction denoted with arrow S1 is the advanced angle direction S1 and the direction denoted with arrow S2 is the retarded angle direction S2. Incidentally, the relatively rotatable range over which the relative rotational phase is displaceable is the range between the most retarded phase where the partitioning portion 5 is displaced maximally toward the retarded angle direction S2 within the fluid pressure chamber 4 and the most advanced phase where the partitioning portion 5 is displaced maximally toward the advanced angle direction S1 within the fluid pressure chamber 4. FIG. 2 shows the condition of the most advanced phase.

The member 15 shown in FIG. 1 is a torsion spring 15 provided between the inner rotor 3 and the front plate 8 affixed to the outer rotor 1. This torsion spring 15 constantly urges the inner rotor 3 and the outer rotor 1 in the direction of the relative rotational phase being displaced in the advanced angle direction S1.

(Construction of Locking Mechanism)

As shown in FIG. 2, between the outer rotor 1 and the inner rotor 3, there is provided the locking mechanism 13 capable of restricting the relative rotational phase therebetween within a predetermined locking phase. This locking mechanism 13 includes a sliding groove 13*b*, a locking member 13*c* slidable along the sliding groove 13*b*, and an urging spring 13*d* for urging the locking member 13*c* toward the engaging recess 13*a*. The sliding groove 13*b* is provided in one 10*a* of the plurality of projecting portions 10 of the outer rotor 1, which one is formed wider than the others. The engaging recess 13*a* is provided in the inner rotor 3 such that the radially inner end of the locking member 13*c* is engageable therewith when the relative rotational phase is at the predetermined locking phase. Therefore, the urging spring 13*d* urges the locking member 13*c* toward the inner radial side.

When the relative rotational phase is at the predetermined locking phase, under the urging force of the urging spring 13*d*, the locking member 13*c* projects into the engaging recess 13*a* to be engaged therein. Hence, the locking mechanism 13 is rendered into the locking condition thereby to restrict the relative rotational phase to the predetermined locking phase. Incidentally, as this embodiment relates to a valve timing control mechanism for the exhaust side, the predetermined locking phase is the most retarded phase. When the relative rotational phase is the predetermined locking phase, when the operational oil from the hydraulic circuit 6 is fed through the retarded angle passageway 12 into the engaging recess 13*a*, the locking member 13*c* is retracted away from the engaging recess 13*a*. This provides the lock released state which allows displacement in the relative rotational phase between the inner rotor 3 and the outer rotor 1.

(Construction of Phase Displacement Restricting Mechanism)

As shown in FIGS. 4A through 7B and FIG. 9, between the outer rotor 1 and the inner rotor 3, there is provided a phase displacement restricting mechanism 17 for creating a restricting state where the relative rotational phase displacement is restricted within a predetermined permissible range and an unrestricting state where the restriction is released. This predetermined phase displacement permissible range can be set to a predetermined range including the predetermined locking phase to facilitate the engagement of the locking member 13*c* relative to the engaging recess 13*a* at the time of stopping the engine.

The phase displacement restricting mechanism 17 includes a storing portion 18, a restricting recess portion 19, and a projecting/retracting member 20. The storing portion 18 is formed in the wide partitioning portion 5*a* of the plurality of partitioning portions 5 along the axial direction. The restricting recess portion 19 is formed in the front plate 8 of the outer rotor 1. The projecting/retracting member 20 is slidably stored within the storing portion 18, so that the projecting/retracting member 20 can project/retract from/into the storing portion 18. When the leading end of the projecting/retracting member 20 projects from the storing portion 18 and is inserted into the restricting recess portion 19, there is realized a restricting state. Whereas, when the leading end of the projecting/retracting member 20 retracts into the storing portion 18 away from the restricting recess portion 19, there is realized an unrestricting state. The projecting/retracting member 20 is urged to be inserted into the restricting recess portion 19 by an urging spring 27.

Figure 4A:
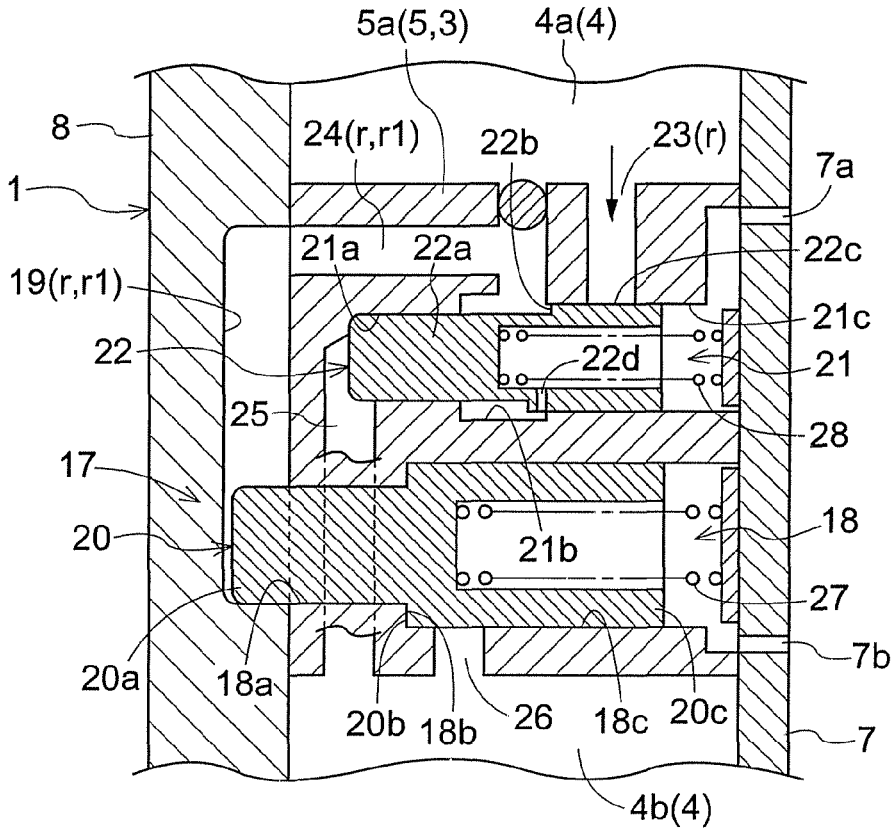
FIG. 4A is a view showing conditions of a valving element and the phase displacement restricting mechanism at the time of engine startup.
Figure 4B:
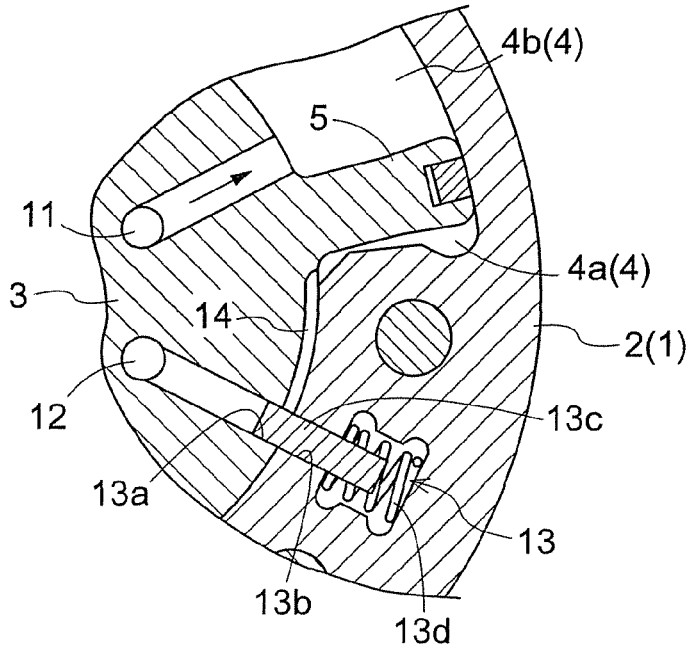
FIG. 4B is a view showing the condition of a locking mechanism at the time of engine startup.
Figure 5A:
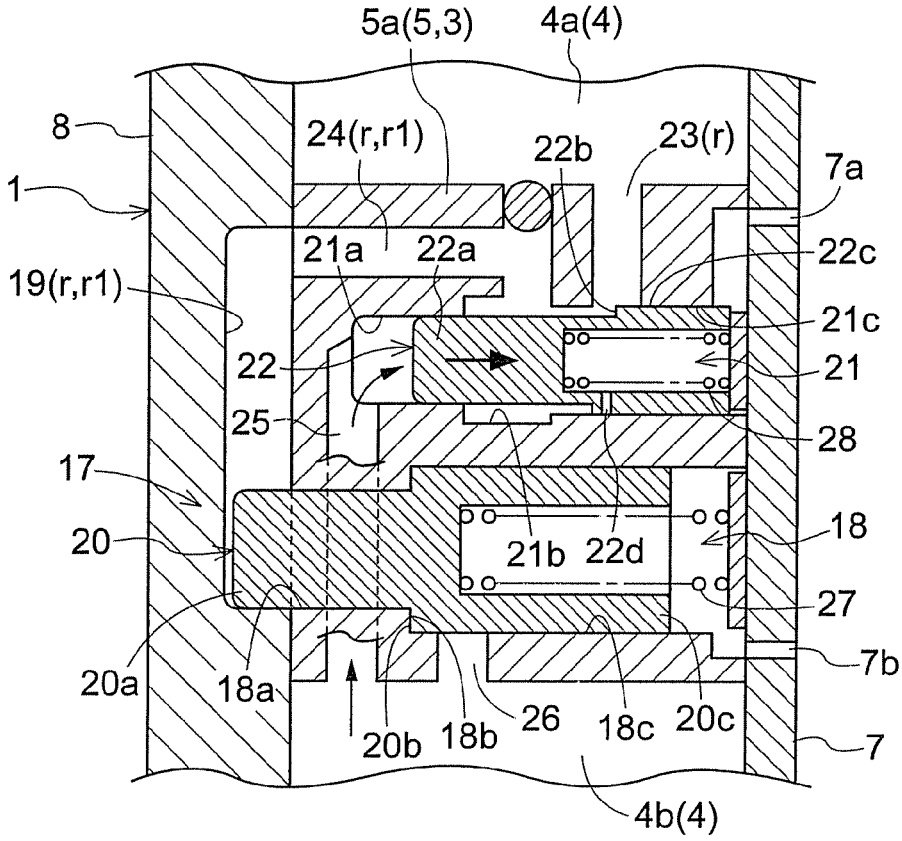
FIG. 5A is a view showing the conditions of the valving element and the phase displacement restricting mechanism at the time of restriction.

The projecting/retracting member 20 includes a small diameter portion 20*a* formed on the side of the leading end adjacent the front plate 8 and a large diameter portion 20*c* on the side of the base end adjacent the rear plate 7. Between the small diameter portion 20*a* and the large diameter portion 20*c*, a stepped portion 20*b* is formed. The storing portion 18 includes a small diameter portion 18*a* on the side of the leading end and a large diameter portion 18*c* on the side of the base end. Between the small diameter portion 18*a* and the large diameter portion 18*c*, a stepped portion 18*b* is formed. Therefore, as shown in FIG. 4A, and FIG. 5A, when there is provided the restricting state in response to the projection of the projecting/retracting member 20 by the urging spring 27, the stepped portion 20*b* of the projecting/retracting member 20 comes into engagement with the stepped portion 18*b* of the storing portion 18, thus preventing the leading end of the projecting/retracting member 20 from coming into contact with the bottom face of the restricting recess portion 19. The large diameter portion 18*c* is communicated with the outside through a leak through hole 7*b* formed in the rear plate 7.

Figure 3:
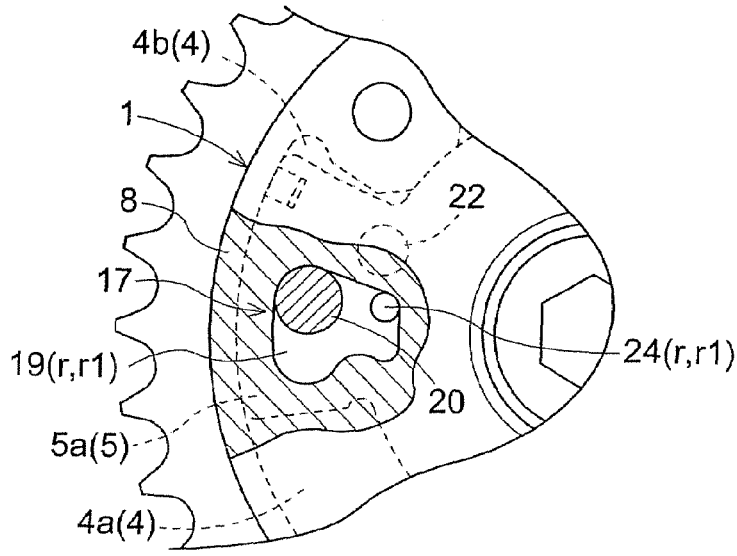
FIG. 3 is an enlarged vide showing a communication passageway and a phase displacement restricting mechanism.

The restricting recess portion 19 has a depth designed to allow insertion of the leading end of the projecting/retracting member 20 and also has a length along the rotational direction corresponding to the predetermined phase displacement permissible range as shown in FIG. 3. With these arrangements, under the restricting state with the projecting/retracting member 20 being inserted into the restricting recess portion 19, the relative rotational phase can be displaced within the predetermined phase displacement permissible range. Incidentally, if the displacement of the relative rotational phase exceeds the predetermined phase displacement permissible range, the projecting/retracting member 20 comes into contact with the lateral face of the restricting recess portion 19, whereby any further displacement is prevented.

(Constructions of Valving Element Chamber and Valving Element)

In midway of a communication passageway communicating (r) which establishes communication between the phase displacement restricting mechanism 17 and the advanced angle chamber 4*a*, there is provided a valving element chamber 21. In this valving element chamber 21, a valving element 22 is mounted so as to selectively provide a closing state for closing the communicating passageway (r) and an opening state for opening up the communication passageway (r). More particularly, the closing state is a state wherein the communication passageway (r) is closed to render the phase displacement restricting mechanism 17 into the restricting state. The opening state is a state wherein the communication passageway (r) is opened up and the operational oil is fed into the advanced angle chamber 4*a*, thereby to render the phase displacement restricting mechanism 17 into the unrestricting state.

The valving element 22 is slidably stored within the valving element chamber 21 and includes a small diameter portion 22*a* on the side of the leading end a large diameter portion 22*c* on the side of the base end, the valving element 22 being formed like a cylinder with a closed end. Between the small diameter portion 22*a* and the large diameter portion 22*c*, a stepped portion 22*b* is formed. The valving element chamber 21 is formed in the wide partitioning portion 5*a* of the plurality of the partitioning portions 5, in juxtaposition with the storing portion 18 of the phase displacement restricting mechanism 17. Further, between the valving element chamber 21 includes, between the small diameter portion 21*a* and the large diameter portion 21*c*, an enlarged diameter portion 21*b* whose diameter is enlarged to an extent not to contact an outer peripheral portion of the valving element 22. The valving element 22 is urged to the side of the leading end by an urging spring 28. The large diameter portion 21*c* is communicated with the outside through a leak through hole 7*a* formed in the rear plate 7.

The wide partitioning portion 5*a* forms a first passageway 23 capable of establishing communication between the large diameter portion 21*c* and the advanced angle chamber 4*a*, a second communication passageway 24 capable of establishing communication between the enlarged diameter portion 21*b* and the restricting recess portion 19, a third communication passageway 25 capable of establishing communication between the small diameter portion 21*a* and the retarded angle chamber 4*b*, and a fourth communication passageway 26 capable of establishing communication between the large diameter portion 18*c* and the retarded angle chamber 4*b*. The first communication passageway 23, the valving element chamber 21, the second communication passageway 24 and the restricting recess portion 19 together constitute the communication passageway (r) for establishing communication between the phase displacement restricting mechanism 17 and the advanced angle chamber 4*a*.

When the valving element 22 is moved to the leading end side by the urging spring 28, as shown in FIG. 4A, there is realized the closing state wherein the large diameter portion 22*c* closes the first passageway 23 and the valving element 22 loses the communication passageway (r). Under this state, even if operational oil from the hydraulic circuit 6 is supplied to the first passageway 23 via the advanced angle chamber 4*a*, the phase displacement restricting mechanism 17 maintains the restricting state since the first passageway 23 is closed.

Figure 6A:
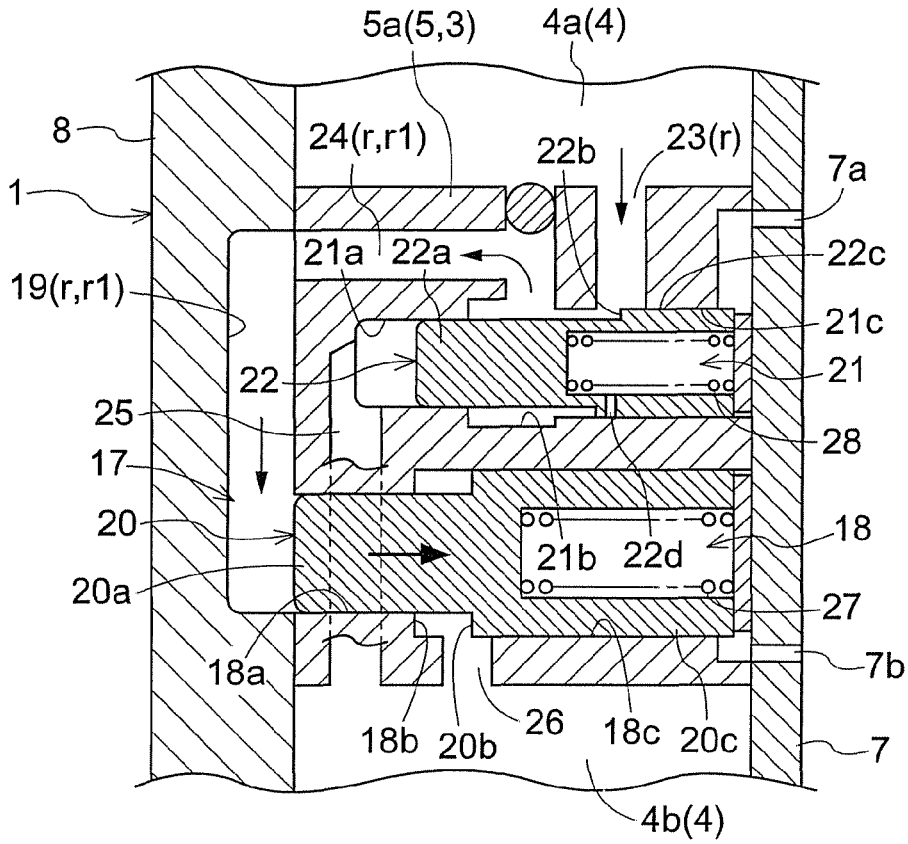
FIG. 6A is a view showing conditions of the valving element and the phase displacement restricting mechanism at the time of release of restriction.
Figure 7A:
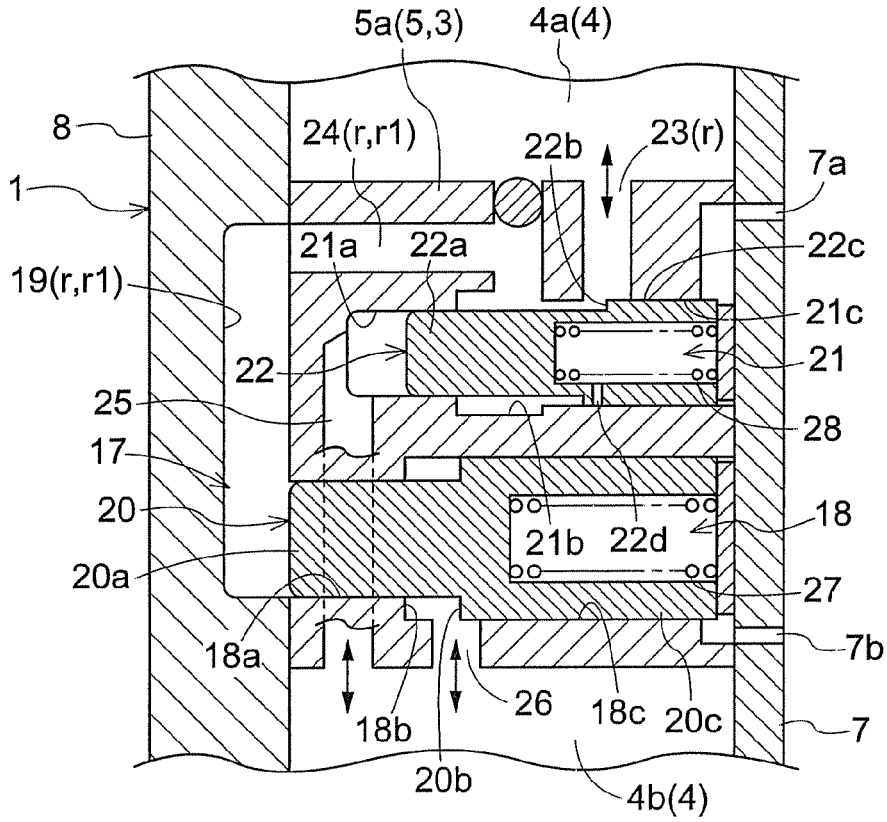
FIG. 7A is a view showing conditions of the valving element and the phase displacement restricting mechanism at the time of normal operation.

When the valving element 22 is moved to the base end side, in response to feeding of operational oil from the hydraulic circuit 6 to the leading end of the small diameter portion 21*a* of the valving element chamber 21 via the retarded angle chamber 4*b* and the third passageway 25, as shown in FIG. 5A, FIG. 6A and FIG. 7A, a gap is formed between the valving element 22 and the valving element chamber 21, thereby to establish communication between the first passageway 23 and the second passageway 24, so that the there is realized the opening state wherein the valving element 22 opens up the communication passageway (r). In this, if the operational oil from the hydraulic circuit 6 is supplied to the restricting recess 19 via the advanced angle chamber 4*a*, the first passageway 23, the valving element chamber 21 and the second passageway 24, the projecting/retracting element 20 is retracted to render the phase displacement restricting mechanism 17 into the releasing state.

(Construction of Leak Passageway)

In the valving element 22, there is provided a leak through hole 22*d* as a "leak passageway" configured to allow leakage of fluid from an intermediate passage (r1) to the outside, the intermediate passage (r1) comprising a space which is located between the valving element 22 and the phase displacement restricting mechanism 17 and constituting a portion of the communication passageway (r). As shown in FIG. 4A etc., the leak through hole 22*d* is provided at the large diameter portion 22*c* of the valving element 22. In operation, even when the valving element 22 is under the closing state, the operational oil is allowed to leak to the outside from the intermediate passage (r1) through the leak through hole 22*d*.

As shown in FIG. 5A, 6A, 7A, etc., when the valving element 22 is under the opening condition, the large diameter portion 22*c* of this valving element 22 is in gapless contact with the enlarged diameter portion 21*b* of the valving element chamber 21, thereby to close the leak through hole 22*d*. On the other hand, as shown in FIG. 4A, when the valving element 22 is under the closing state, a gap is formed between the large diameter portion 22*c* of this valving element 22 and the enlarged diameter portion 21*b* of the valving element chamber 21. That is, the leak through hole 22*d* is opened up to establish communication between the second passageway 24 and the outside.

Figure 9:
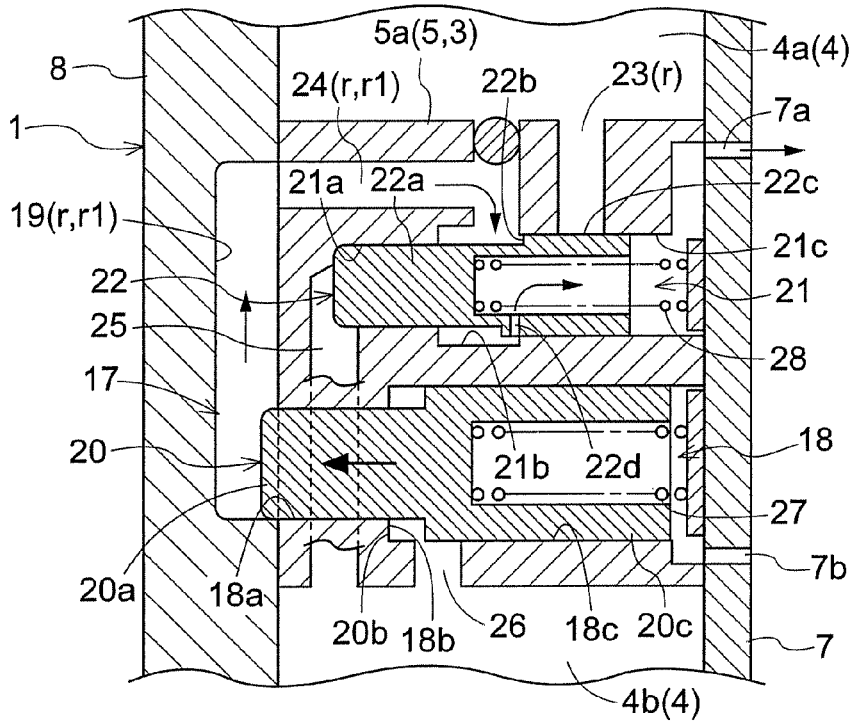
FIG. 9 is a view showing the conditions of the valving element and the phase displacement restricting mechanism at the time of engine stop.

For example, when the engine is stopped, even if the valving element 22 is rendered into the closing state faster, with the phase displacement restricting mechanism 17 being under the releasing state, since the leak through hole 22*d* is opened, communication is established between the second passageway 24 and the outside. As shown in FIG. 9, the operational oil present in the restricting recess portion 19 and the second passageway 24 will flow through the leak through hole 22*d* and the inside of the valving element 22 to the outside from the leak through hole 7*a* of the rear plate 7. In association with this leak of the operational oil of the restricting recess portion 19 and the second passageway 24, the projecting/retracting member 20 is inserted into the restricting recess portion 19, whereby the phase displacement restricting mechanism 17 can readily return from the releasing state to the restricting state.

If the leak passageway is formed as the leak through hole 22*d* provided in the outer peripheral portion of the valving element 22 as described above, the construction which allows facilitated return of the phase displacement restricting mechanism from the releasing state to the restricting state can be constructed by the simple arrangement of only defining the leak through hole in the valving element.

Further, as the gap is formed between the outer peripheral portion of the valving element 22 and the enlarged diameter portion 21*b* of the valving element chamber 21, even when the valving element 22 is under the closing state, the operational oil of the intermediate passage (r1) leaks to the outside through this gap and the leak passageway. Hence, there can be obtained the construction which allows facilitated return of the phase displacement restricting mechanism from the releasing state to the restricting state. In addition, when the valving element 22 is under the opening state, the outer peripheral portion of the valving element 22 is placed in gapless contact with the valving element chamber 22, thereby to close the leak through hole 22*d*. As a result, excessive leak of operational oil can be restricted and waste of operational oil can be minimized.

(Operations of Valve Timing Control Device)

Next, the operations of the valve timing control device will be described with reference to FIGS. 4A through 8. When the engine is started, as shown in FIG. 4A, the phase displacement restricting mechanism 17 is under the restricting state and the valving element 22 is under the closing state. Further, the locking mechanism 13 is under the locking state as shown in FIG. 14B. Under this condition, the relative rotational phase is restricted to the predetermined locking phase. For starting the engine, as indicated by the period T1 in FIG. 8 and shown in FIG. 4A, first, operational oil is supplied to the advanced angle chamber 4*a*.

Figure 5B:
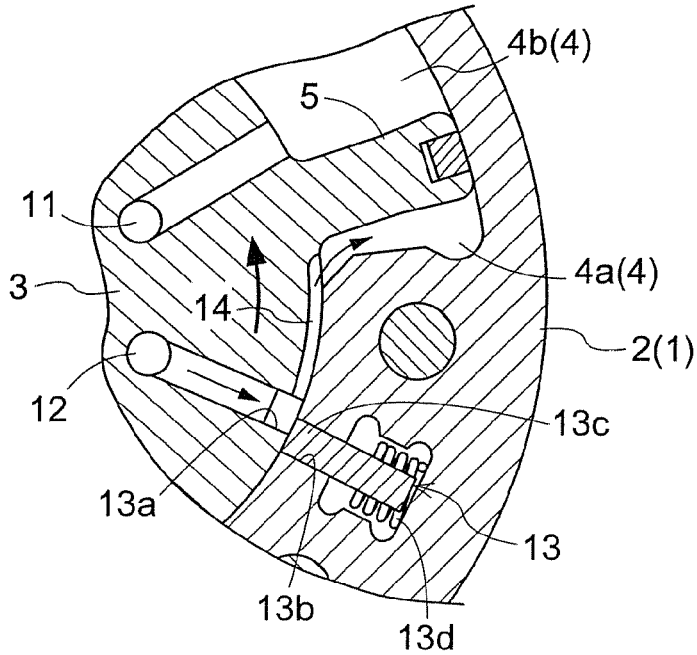
FIG. 5B is a view showing the condition of the locking mechanism at the time of restriction.
Figure 8:
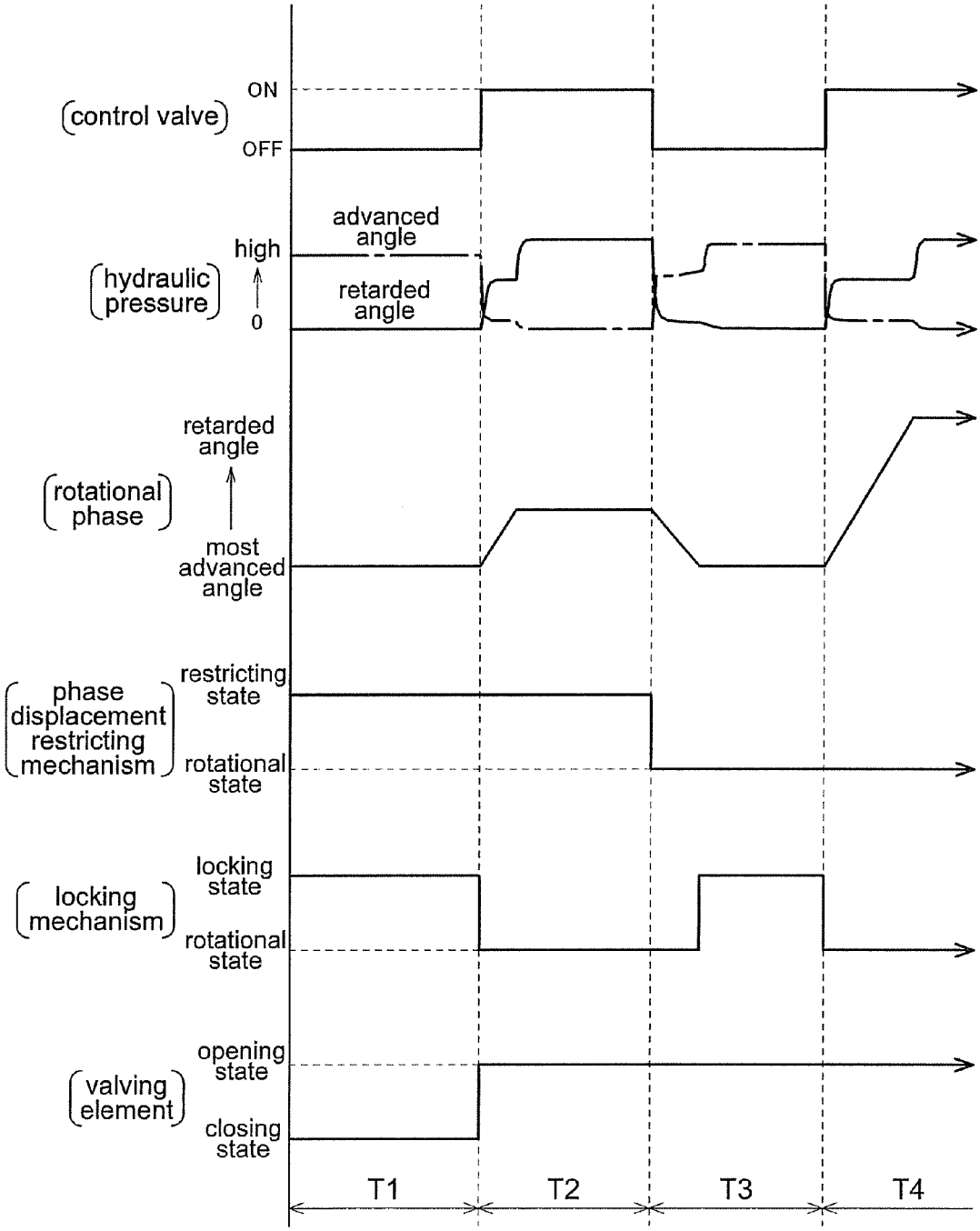
FIG. 8 is a timing chart illustrating control of the valve timing control device.

Next, as shown by the period T2 in FIG. 8, when the operational oil is supplied to the retarded angle chamber 4*b*, as shown in FIG. 5B, the locking mechanism 13 is rendered into the locking releasing state, and also as shown in FIG. 5A, the valving element 22 is rendered into the opening condition. As shown by the period T2 is FIG. 8, under the above condition, the supply of the operational oil to the advanced angle chamber 4*a* is temporarily stopped. Therefore, the phase displacement restricting mechanism 17 maintains the restricting state, so that displacement of the relative rotational phase is restricted within the predetermined phase displacement permissible range.

Figure 6B:
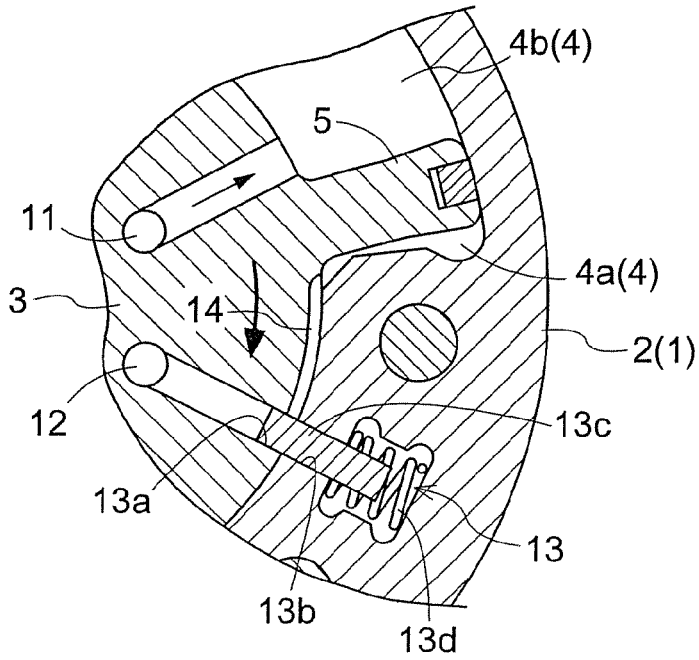
FIG. 6B is a view showing the condition of the locking mechanism at the time of release of restriction.

Subsequently, as shown by the period T3 in FIG. 8, when the operational oil is supplied to the advanced angle chamber 4*a*, the restriction of the relative rotational phase is released as shown in FIG. 6A. With this, as shown in FIG. 6B, the relative rotational phase is returned slightly to the set locking phase, and the locking mechanism 13 is rendered into the locking state again.

Figure 7B:
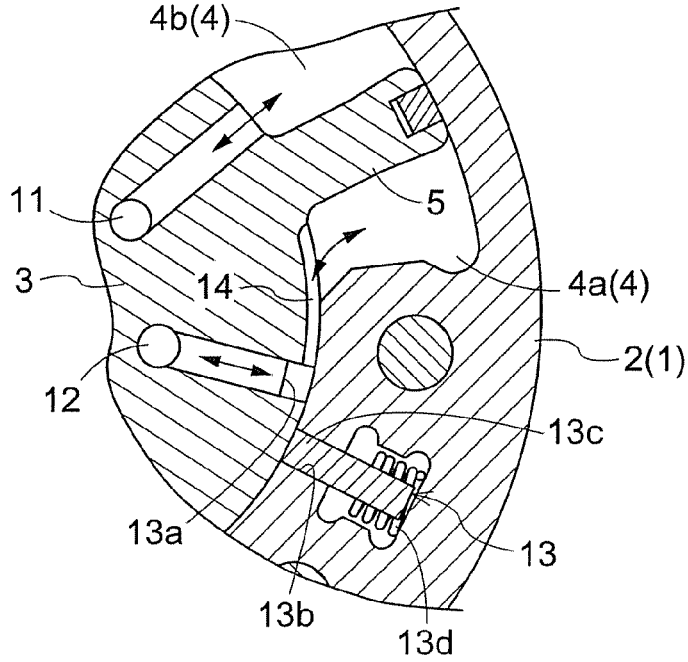
FIG. 7B is a view showing the condition of the locking mechanism at the time of normal operation.

During the normal operation of the engine after the period T4 in FIG. 8, the operational oil is supplied to the advanced angle chamber 4*a* and the retarded angle chamber 4*b*. So, as shown in FIG. 7A, the restricting state of the phase displacement restricting mechanism 17 is released, and as shown in FIG. 7B, the locking mechanism 13 is rendered into the lock releasing state. By controlling the supply of the operational oil to the advanced angle chamber 4*a* and the retarded angle chamber 4*b*, the relative rotational phase can be displaced from the most retarded phase to the most advanced phase and the opening/closing timing of the valve can be varied according to the operational condition.

The valve mechanism consisting essentially of the valving element 22 and the valving element chamber 21 is not limited to the construction described above, but can be modified as described in a first modified embodiment as follows.

Figure 10A:
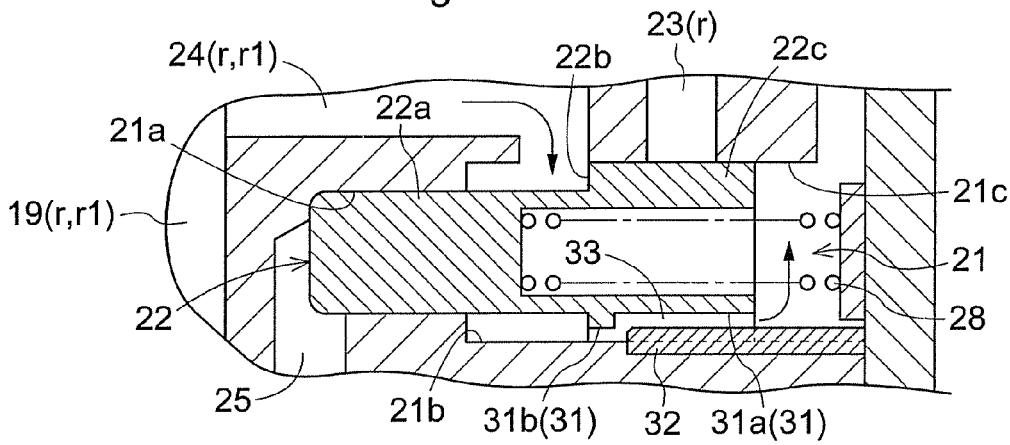
FIG. 10A is a view showing the condition of a valving element of a first modified embodiment at the time of engine stop.
Figure 10B:
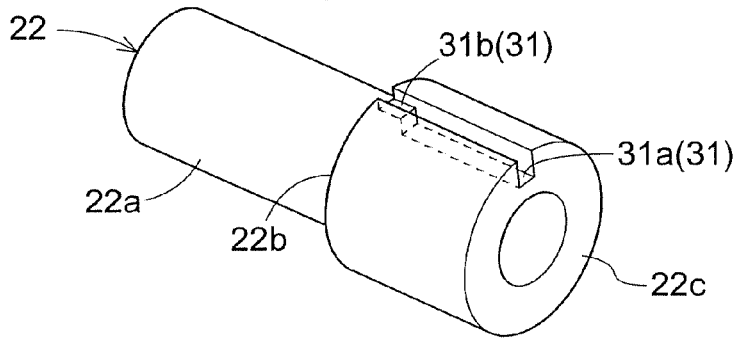
FIG. 10B is an outer appearance view of the valving element of the first modified embodiment.

As shown in FIG. 10B, in the base end side large diameter portion 22*c* of the valving element 22, there is provided a cutout groove 31 along the moving direction (longitudinal direction in the figure) of the valving element 22. On the other hand, in the valving element chamber 21, there is provided a projecting rib 32 which comes into engagement with the cutout groove 31 to allow movement of the valving element 22 along its moving direction and which prevents rotation of the valving element 22 relative to the valving element chamber 21 at the same time. A gap 33 formed between the cutout groove 31 and the projecting rib 32 constitutes a "leak passageway".

More particularly, of the cutout groove 31, its base end side groove 31*a* is formed deeper than its leading end side groove 31*b*. When the valving element 22 is under the closing state, as shown in FIG. 10A, the gap 33 forms a bent passageway. When the valving element 22 is under the opening state, the bottom face of the leading end side groove 31*b* and the leading end face of the projecting rib 32 are in adjacent opposition to each other, thereby to close the gap 33.

The valve mechanism consisting essentially of the valving element 22 and the valving element chamber 21 is not limited to the constructions described above, but can be further modified as described in a second modified embodiment as follows.

Figure 11A:
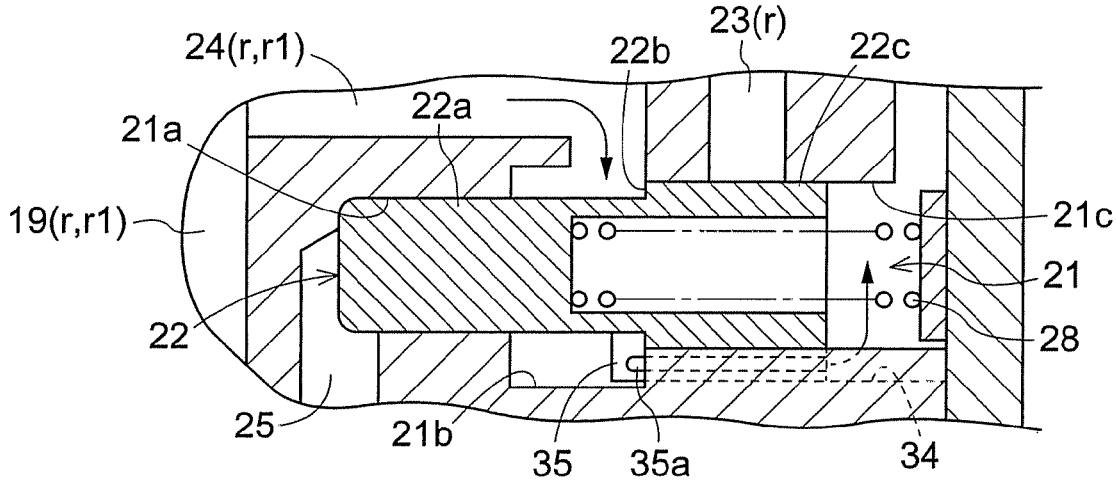
FIG. 11A is a view showing the condition of a valving element of a second modified embodiment at the time of engine stop.
Figure 11B:
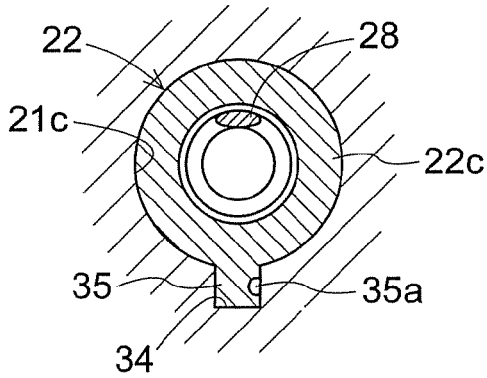
FIG. 11B is a section view of the valving element of the second modified embodiment.
Figure 11C:
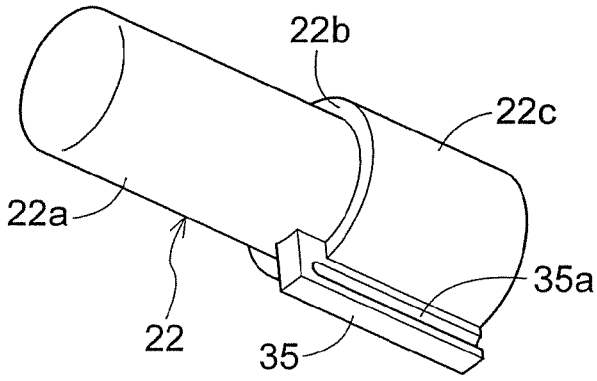
FIG. 11C is an outer appearance view of the valving element of the second modified embodiment.

As shown in FIG. 11A and FIG. 11B, the valving element chamber 21 is provided with a cutout groove 34 along the operational direction (longitudinal direction in the figures) of the valving element 22. As shown in FIGS. 11A through 11C, in the outer peripheral portion of the valving element 22, there is provided a projecting rib 35 which comes into engagement with the cutout groove 34 to allow movement of the valving element 22 along its moving direction and which prevents rotation of the valving element 22 relative to the valving element chamber 21 at the same time. A gap formed between the cutout groove 34 and the projecting rib 35 constitutes a "leak passageway".

More particularly, in the lateral face of the projecting rib 35, a leak groove 35*a* is formed as a gap. As shown in FIG. 11A and FIG. 11C, the leak groove 35*a* is formed in the base end side large diameter portion 33*c* of the valving element 22 in such a manner than the leading end of the groove is located at a position not reaching the stepped portion 22*b*. When the valving element 22 is under the closing state, the projecting rib 35 projects from the cutout groove 34 and the leading end of the leak groove 35*a* is exposed. When the valving element 22 is under the opening state, the projecting rib 35 is retracted into the cutout groove 34. With this, as the leak groove 35*a*, including its leading end on the side of the stepped portion 22*b*, is hidden within the groove 34, so the leak passageway is closed.

In the first modified embodiment and the second modified embodiment described above, the cutout groove 34 along the operational direction of the valving element 22 is provided in one of the outer peripheral portion of the valving element 21 and the valving element chamber 21 and the projecting rib 32, 35 engageable with the cutout groove 34 for allowing movement of the valving element 22 along its operational direction and preventing rotation of the valving element 22 relative to the valving element chamber 22 at the same time is provided in the other of the outer peripheral portion of the valving element 21 and the valving element chamber 21. And, the leak passageway is provided as the gap formed between the cutout groove 34 and the projecting rib 32, 35. These arrangements are advantageous in the following respects.

Namely, by the simple arrangement of providing the cutout groove 34 and the projecting rib 32, 35, there can be obtained the construction which allows facilitated return of the phase displacement restricting mechanism 17 from the releasing state to the restricting state. In addition, since the cutout groove 34 and the projecting rib 32, 35 function together as an "anti-rotation means" against rotation of the valving element 22, it is possible to restrict leakage of the operational oil of the intermediate passage r1 which would occur if the valving element 22 rotated while the valving element 22 is under the opening state.

The valving timing control device of the present invention is not limited to the above constructions, but can be modified in various ways as follows.

(1) In the foregoing discussion, the inner rotor 3 is integrally assembled with the leading end of the exhaust side cam shaft C constituting a rotational shaft of the cam controlling opening/closing of the exhaust valve of the engine. Instead of this, the inner rotor 3 may be integrally assembled with the leading end of the intake side cam shaft C constituting a rotational shaft of the cam controlling opening/closing of the intake valve of the engine.

(2) In the foregoing discussion, there was described the construction comprising the fluid pressure chambers 4 formed in the driving side rotational member and the partitioning members 5 provided in the driven side rotational member for partitioning each fluid pressure chamber into the advanced angle chamber 4*a* and the retarded angle chamber 4*b*. Alternatively, the construction can comprise the fluid pressure chambers 4 provided in the driven side rotational member and the partitioning members 5 provided in the driving side rotational member for partitioning each fluid pressure chamber into the advanced angle chamber 4*a* and the retarded angle chamber 4*b*.

(3) In the foregoing discussion, the partitioning portions 5 are provided at the portions in the outer peripheral portion of the inner rotor 3 facing the respective fluid pressure chambers 4. However, the invention is not limited thereto. Instead, grooves can be formed in the outer peripheral portion of the inner rotor 3 at positions opposed to the respective fluid pressure chambers 4, and plate-like members being fitted therein, to constitute the partitioning members.

(4) In the foregoing discussion, the communication passageway (r) establishes communication between the phase displacement restricting mechanism 17 and the advanced angle chamber 4*a*. The invention is not limited thereto. The communication passageway (r) can be modified to establish communication between the phase displacement restricting mechanism 17 and the retarded angle chamber 4*b*.

Second Embodiment

Next, there will be described, with reference to the accompanying drawings, a further embodiment in which a valving timing control device relating to the present invention is applied to an automobile engine as an internal combustion engine.

(General Construction)

This valve timing control device 101 includes an outer rotor 102 synchronously rotatable with an unillustrated crankshaft of an engine as an internal combustion engine, and an inner rotor 103 coaxial with the outer rotor 102 and synchronously rotatable with an unillustrated valving opening/closing cam shaft of the engine. Here, the outer rotor 102 corresponds to a "driving side rotational member" defined in the present invention and the inner rotor 103 corresponds to a "drive side rotational member" defined in the present invention.

The inner rotor 103 is assembled integrally to a leading end portion of an exhausting side cam shaft 111 which constitutes a rotational shaft of a cam for controlling opening/closing of an intake valve or an exhaust valve of the engine. This cam shaft 111 is rotatably assembled with an unillustrated cylinder head of the engine.

The outer rotor 102 is mounted on the outer side of the inner rotor 103 to be rotatable relative thereto within a predetermined range. And, a rear plate 121 to which the cam shaft 111 is connected and a front plate 122 opposite to the side connected to the cam shaft 111 are mounted integrally to the outer rotor 102 and the inner rotor 103. On the outer periphery of the outer rotor 102, a timing sprocket 123 is formed. Between and across this timing sprocket 123 and an unillustrated gear mounted on the crankshaft of the engine, there is provided an unillustrated force transmitting member 112 such as a timing chain, a timing belt, etc.

Figure 13:
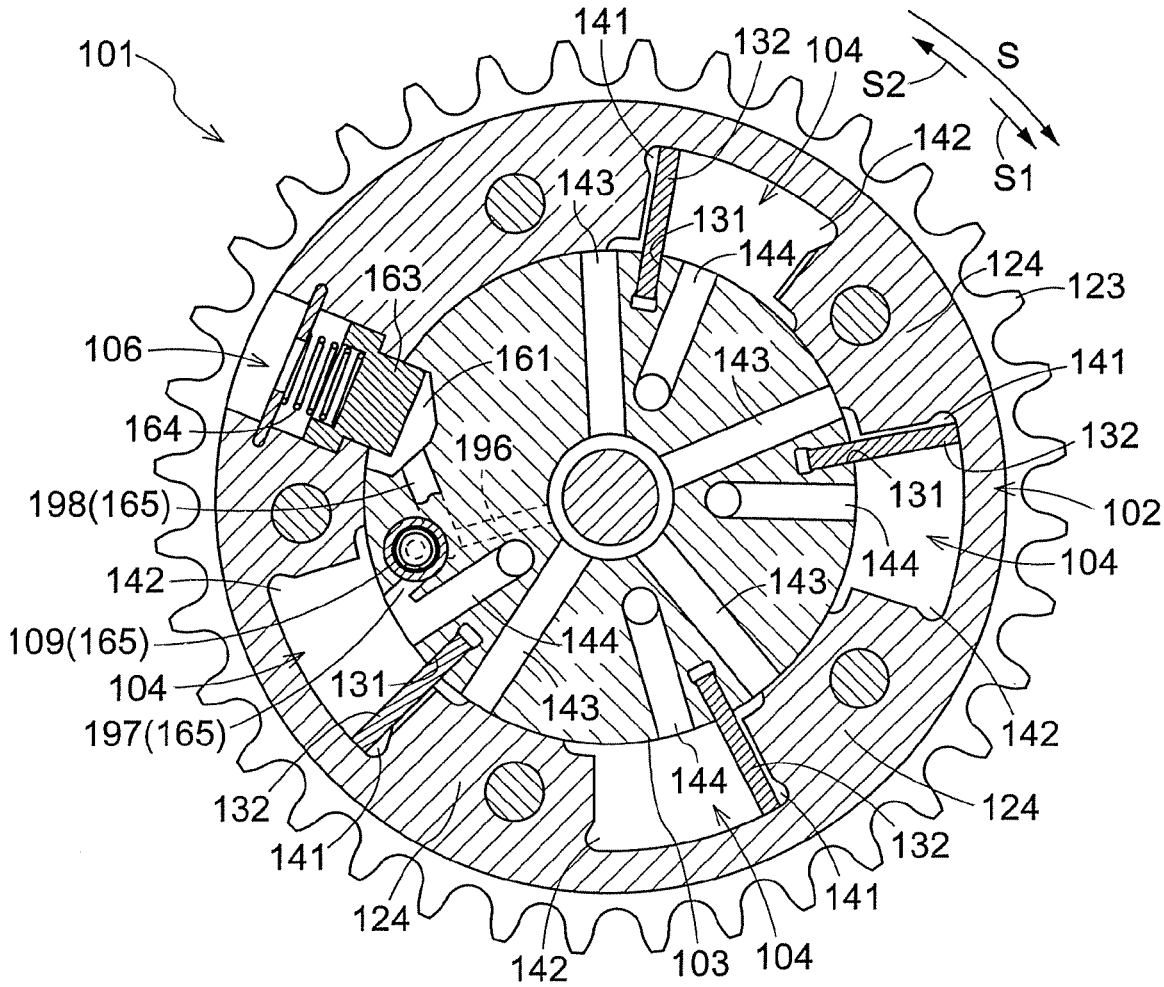
FIG. 13 is a section taken along XIII-XIII in FIG. 12 at the time of most retarded phase.

In operation, when the crankshaft of the engine is driven to rotate, this rotational force is transmitted via the force transmitting member 112 to the timing sprocket 123, whereby the outer rotor 102 is driven to rotate along a rotational direction S shown in FIG. 13. In association with this rotational drive of the outer rotor 102, the inner rotor 103 is driven to rotate along the rotational direction S shown in FIG. 13 and the cam shaft 111 is rotated. Then, the cam mounted on the cam shaft 111 pushes down the intake value or the exhaust vale of the engine thereby to open this valve.

As shown in FIG. 13, the outer rotor 102 includes a plurality of projecting portions 124 projecting along the radial direction, with the projecting portions 124 being provided in juxtaposition along the rotational direction. And, between respective adjacent pairs of projecting portions 124 adjacent along the peripheral direction (rotational direction S) of the outer rotor 102, fluid pressure chambers 104 are formed. In the instant embodiment, four fluid pressure chambers 104 are formed.

Figure 12:
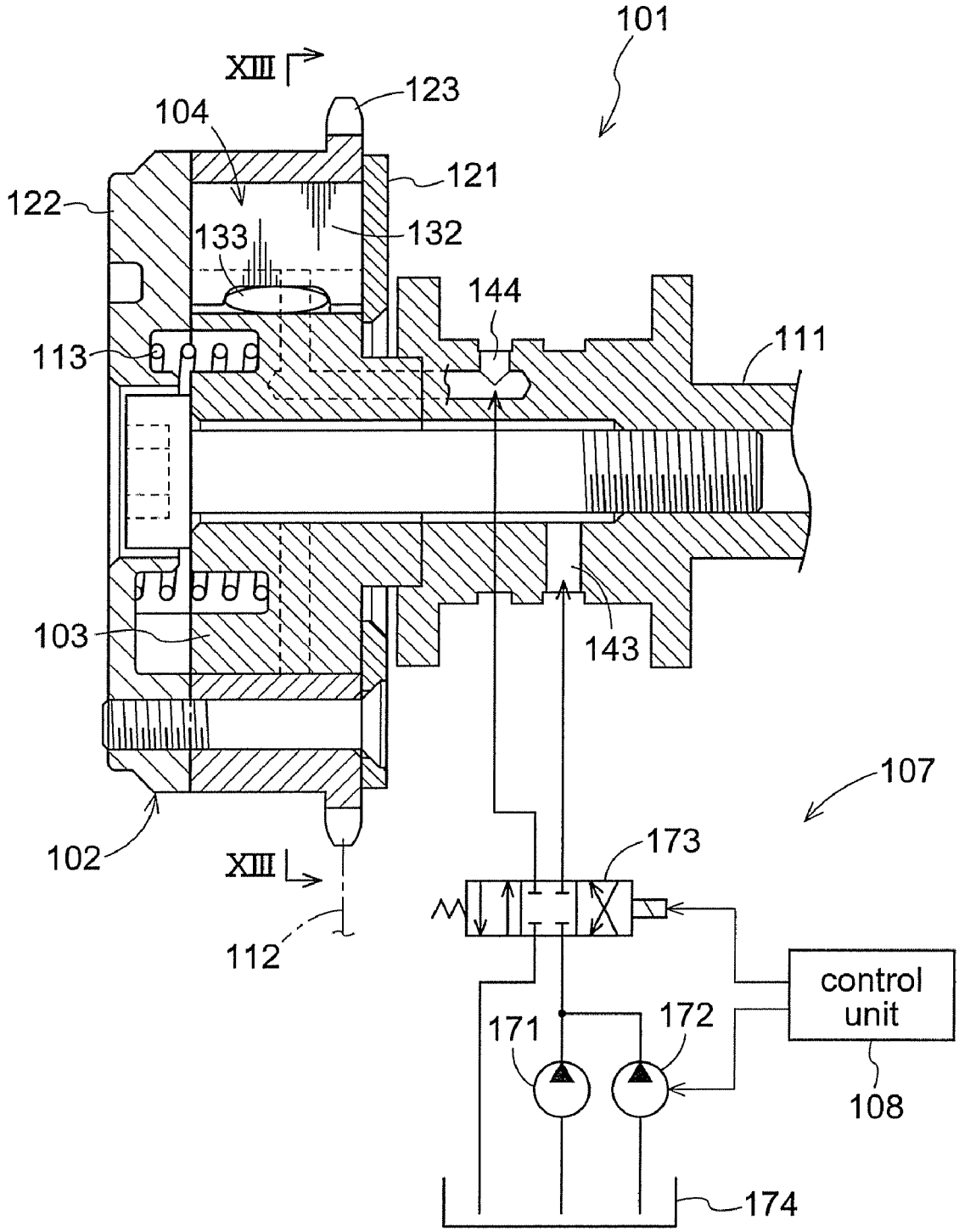
FIG. 12 is a side view in section showing a valve timing control device according to a second embodiment.

Along the outer peripheral portion of the inner rotor 103, and at positions opposed to the respective fluid pressure chambers 104, there are formed vane grooves 131. And, vanes 132 are provided to be slidable into the respective vane grooves 131, with each vane 132, as being inserted, partitioning the fluid pressure chamber 104 corresponding thereto into an advanced angle chamber 141 and a retarded angle chamber 142 along the relative rotational direction comprised of directions of arrows S1, S2 in FIG. 13. This vane 132 corresponds to the "partitioning portion" defined in the present invention. As shown in FIG. 12, this vane 132 is urged to the radially outer side by a spring 133 provided on the inner radial side thereof.

The advanced angle chamber 141 is communicated with an advanced angle passageway 143 formed in the inner rotor 130 whereas the retarded angle chamber 142 is communicated with a retarded angle passageway 144 formed in the inner rotor 103. As shown in FIG. 12, the advanced angle passageway 143 and the retarded angle passageway 144 are communicated to a hydraulic circuit 107 to be described later.

Figure 16:
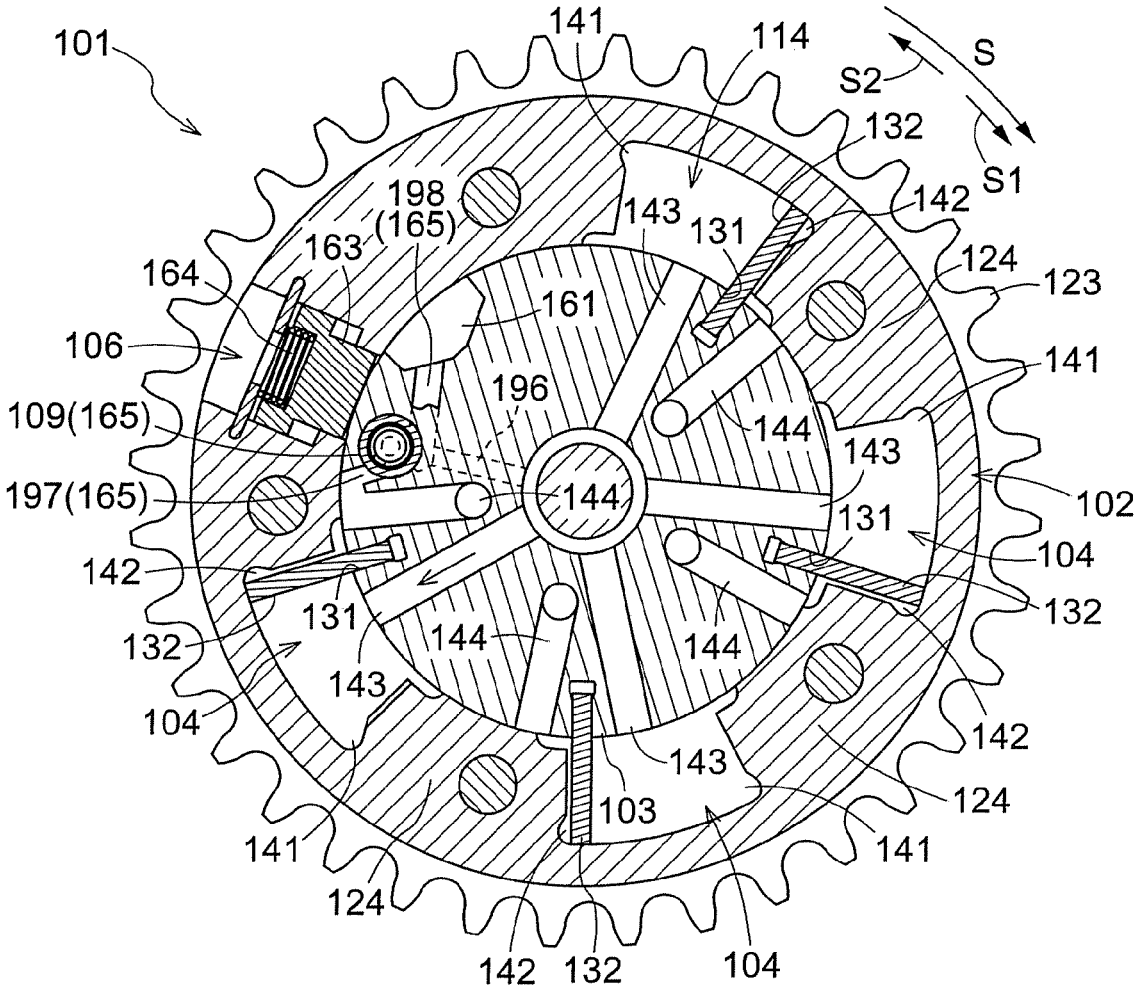
FIG. 16 is a section taken along XIII-XIII in FIG. 12 at the time of most advanced phase.

As the operational oil from the hydraulic circuit 107 is supplied to one or both of the advanced angle chamber 141 and the retarded angle chamber 142, the relative rotational phase between the inner rotor 103 and the outer rotor 102 is displaced to the advance direction S1 or the retardation direction S2 or an urging force is generated for retaining to a desired phase. Here, the advance direction S1 is the direction where the displacing direction of the relative position of the vane 132 is the direction denoted by arrow S1 in FIG. 13. Also, the retardation direction S2 is the direction where the displacing direction of the relative position of the vane 132 is the directed denoted by arrow S2 in FIG. 13. Unless mentioned otherwise explicitly, the relative rotational phase between the inner rotor 103 and the outer rotor 102 will be referred to simply as "relative rotational phase" hereinafter. Further, this operational oil corresponds to the "fluid". The range within which the relative rotational phase is displaceable is the displaceable range of the vane 132 within the fluid pressure chamber 104 and corresponds to the range between the most retarded phase shown in FIG. 13 and the most advanced phase shown in FIG. 16.

As shown in FIG. 12, between the inner rotor 103 and the front plate 122 fixed to the outer rotor 102, a torsion spring 113 is provided. Opposed terminal ends of this torsion spring 113 are retained by unillustrated retaining portions formed in the inner rotor 103 and the front plate 122. And, this torsion spring 113 constantly urges the inner rotor 103 and the outer rotor 102 to the direction of the relative rotational phase being displaced in the advance direction S1.

(Phase Displacement Restricting Mechanism)

Between the outer rotor 102 and the inner rotor 103, there is provided a phase displacement restricting mechanism 106 for creating a restricting state where the relative rotational phase displacement is restricted within a permissible range and an unrestricting state where the restriction is released. The phase displacement restricting mechanism 106 can retain the relative rotational phase within a predetermined range (predetermined phase displacement permissible range). In this embodiment, the predetermined range is set such that one terminal end thereof constitutes a predetermined locking phase and the other terminal end thereof constitutes an intermediate locking phase.

Figure 14:
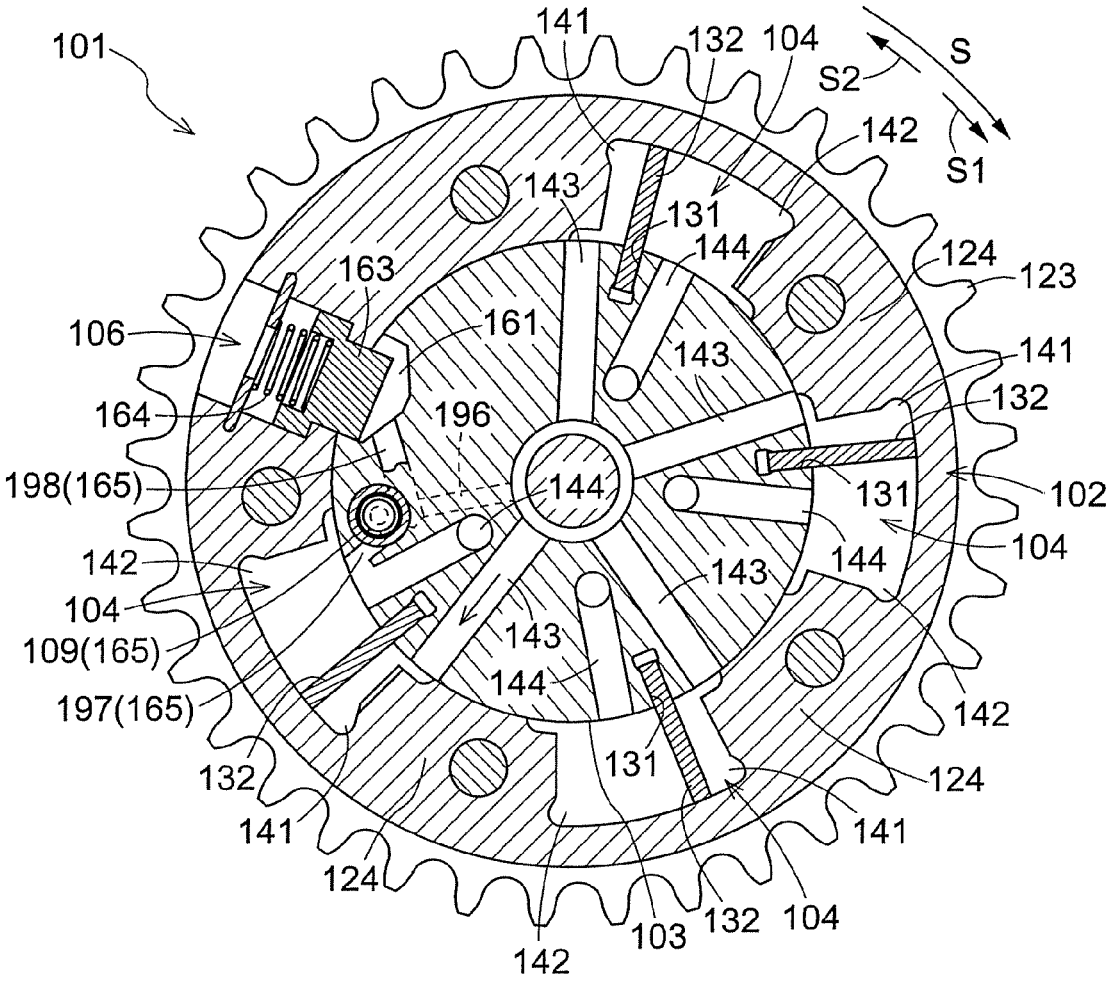
FIG. 14 is a section taken along XIII-XIII in FIG. 12 at the time of intermediate locking phase.

The predetermined locking phase is a phase where good engine starting performance can be obtained when engine conditions such as the temperature of the combustion chamber satisfy predetermined conditions. Here, this phase is set as the most retarded phase which is the limit phase at which the engine can be started regardless of the temperature of the combustion chamber. FIG. 13 corresponds to this most retarded phase. The intermediate locking phase is set as such a phase where stable combustion of engine is effected when the temperature of the combustion chamber is low., in order to reduce hydrocarbons (COLD HC) which are produced immediately after the engine startup. FIG. 14 corresponds to this intermediate locking phase.

The phase displacement restricting mechanism 106 includes a restricting recess portion 161 provided in the inner rotor 103. The phase displacement restricting mechanism 106 further includes a projecting/retracting member 163 provided in the outer rotor 102. This projecting/retracting member 162 can project into or retract from the restricting recess portion 161 and is urged to the side of projecting into the restricting recess portion 161. The state wherein the projecting/retracting member 163 projects into the restricting recess portion 161 is the restricting state. The state wherein the projecting/retracting member 162 retracts away from the restricting recess portion 161 is the unrestricting state. The projecting/retracting member 163 is slidably stored in a storing portion 162 provided in the outer rotor 102 and is urged to the radially inner side by means of an urging spring 164.

Figure 17:
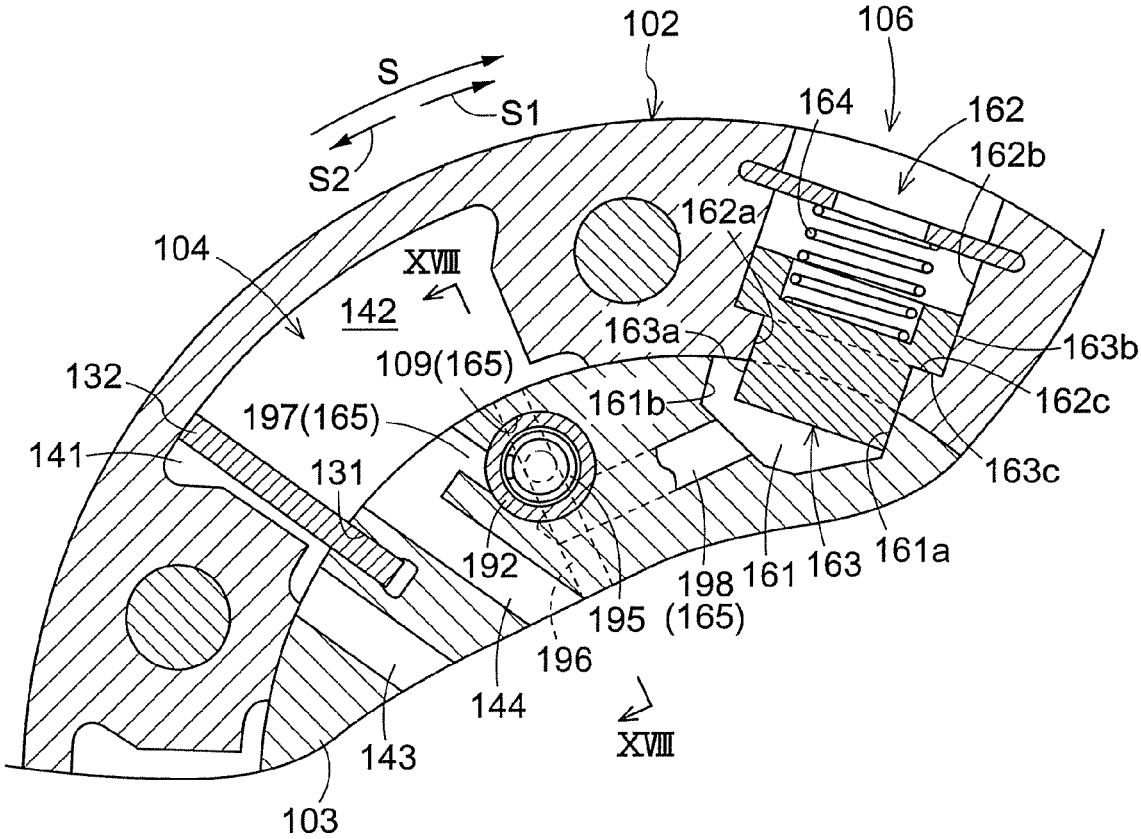
FIG. 17 is an enlarged view showing the periphery of a phase displacement restricting mechanism and a valving element chamber of the second embodiment.

The projecting/retracting member 163, as shown in FIG. 17, is formed concave, with a radially inner small diameter portion 163*a*, a radially outer large diameter portion 163*b* and a stepped portion 163*c* formed between the small diameter portion 163*a* and the large diameter portion 163*b*. The storing portion 162 stores this projecting/retracting member 163, with allowing projection and retraction of this member 163. The storing portion 162 storing the projecting/retracting member 163, with allowing projection and retraction of this member 163, includes a radially inner small diameter portion 162*a*, a radially outer large diameter portion 162*b*, and a stepped portion 162*c* between the small diameter portion 162*a* and the large diameter portion 162*b* and is formed to conform to the shape of the projecting/retracting member 163.

The restricting recess portion 161 is formed with a predetermined depth from the outer peripheral face of the inner rotor 103 such that a portion of the small diameter portion 163*a* of the projecting/retracting member 163 can enter therein. Also, the recess portion 161 is configured such that even under the restricting state with the projecting/retracting member 163 projecting into the restricting recess portion 161, the relative rotational phase can be displaced within the above-described predetermined range and also operational oil fed from the retarded angle chamber can be charged therein. Under the restricting state, the opposed lateral faces of the small diameter portion 163*a* of the projecting/retracting member 163 come into contact with the one end face 161*a* or the other end face 161*b* of the restricting recess portion 161, thereby to restrict displacement of the relative rotational phase.

Figure 18A:
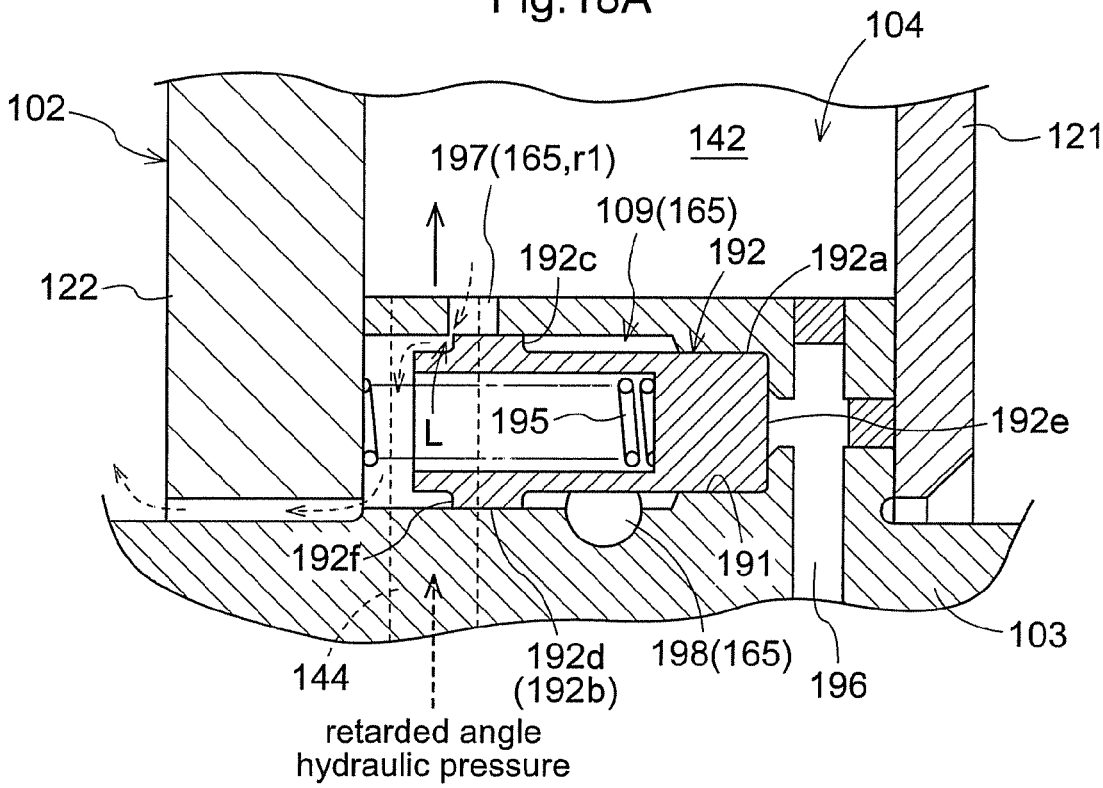
FIG. 18A is a section taken along XVIII-XVIII in FIG. 17 when the valving element is under the closing state.
Figure 18B:
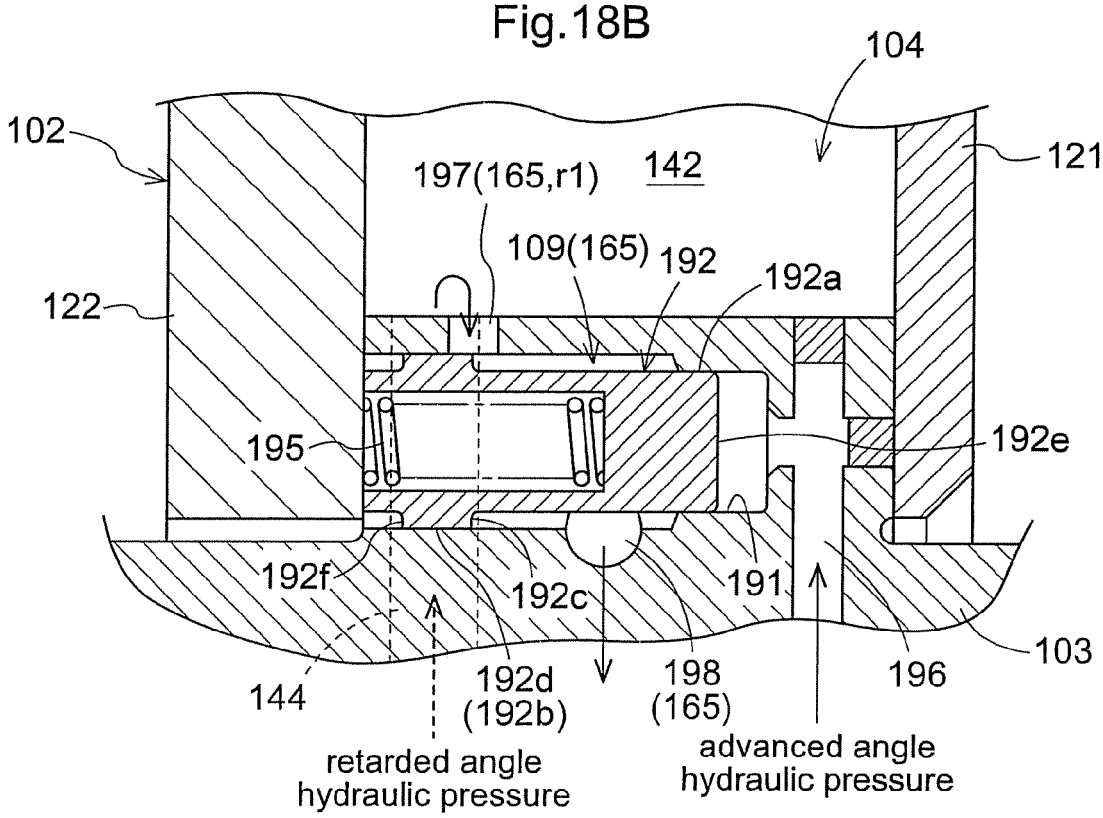
FIG. 18B is a section taken along XVIII-XVIII in FIG. 17 when the valving element is under the opening state.

The communication passageway 165, as shown in FIG. 17, FIG. 18A and FIG. 18B, is formed in the inner rotor 103 and establishes communication between the restricting recess portion 161 and the retarded angle chamber 152 and the retarded angle passageway 144. Therefore, when the operational oil is supplied from the hydraulic circuit 107 to the retarded angle chamber 142, a portion of this operational oil is supplied via the communication passageway 161 to the restricting recess portion 161. Therefore, the projecting/retracting member 163 is retracted away from the restricting recess portion 161, thus realizing the unrestricting state.

Figure 15:
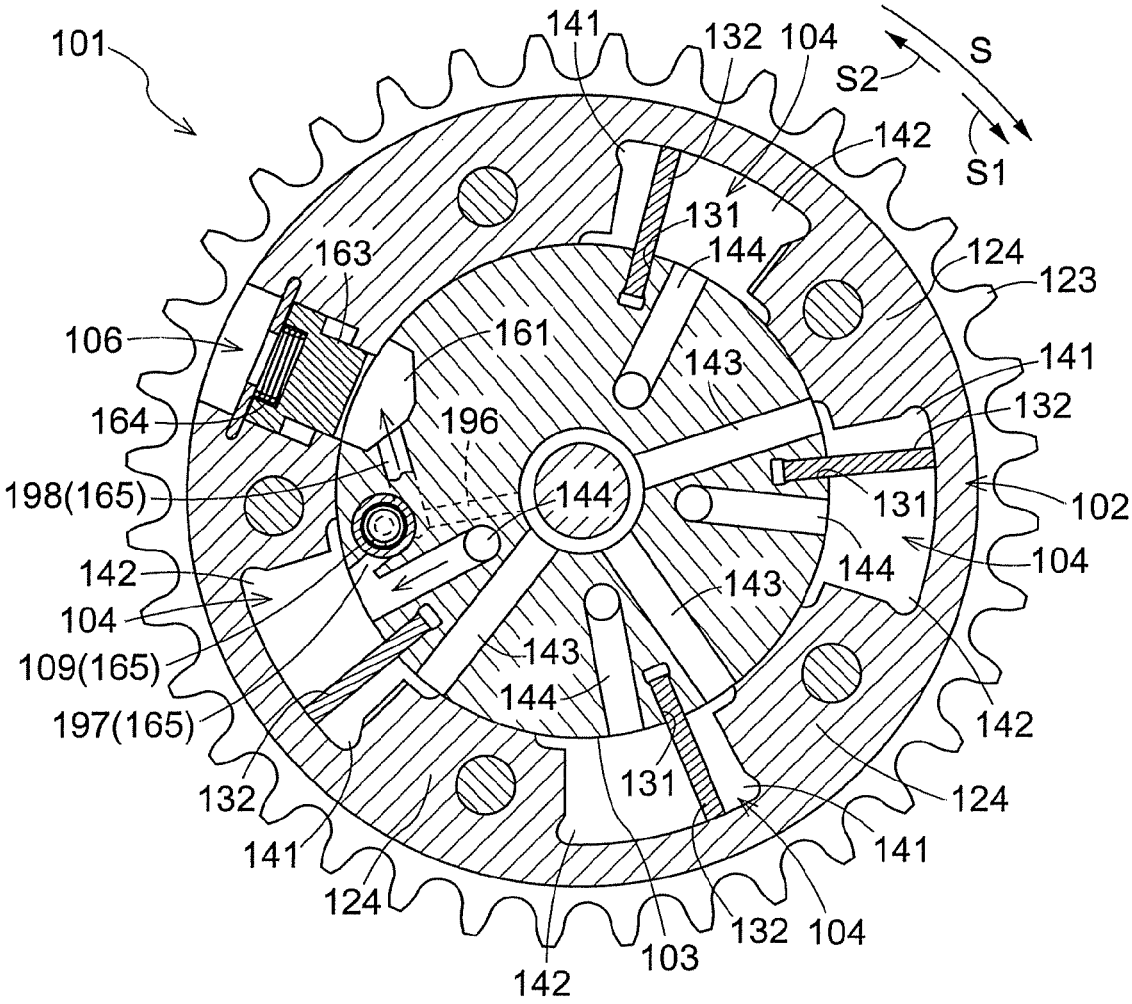
FIG. 15 is a section taken along XIII-XIII in FIG. 12 at the time of release of the intermediate locking.

That is to say, when the operational oil is charged into the restricting recess portion 161 and in response to the pressure of this operational oil, the force urging the projecting/retracting member 163 to the radially outer side exceeds the urging force of the urging spring 164, then, as shown in FIG. 15, the projecting/retracting member 163 is retracted away from the restricting recess portion 161, thus realizing the unrestricting sate which allows the displacement of the relative rotational phase to exceed the predetermined range. On the other hand, when the operational oil is discharged from the restricting recess portion 161, due to the urging force of the urging spring 164, the projecting/retracting member 163 projects into the restricting recess portion 161, thus realizing the restricting state.

(Valving Element Chamber and Valving Element)

As shown in FIG. 17, FIG. 18A and FIG. 18B, the communication passageway 165 which establishes communication between the restricting recess portion 161 of the phase displacement restricting mechanism 106 and the retarded angle chamber 142, incorporates a valving element chamber 109. Within this valving element chamber 109, a valving element 192 is mounted. The valving element chamber 109 is formed along the rotational axis of the inner rotor 103 and the outer rotor 102. The valving element 192 is mounted so as to project and retract in the direction along the rotational axis of the inner rotor 103 and the outer rotor 102.

The valving element chamber 109 includes a valving element recess portion 191 as a recess formed on the cylinder. To this valving element recess portion 191, there is communicated a communication passageway 196 for supplying a portion of the operational oil supplied to the advanced angle chamber 141, to an end portion 192*e* of the valving element 192 which end is to project into the valving element recess portion 191. A portion of the operational oil supplied to the advanced angle chamber 141 is supplied via the communication passageway 196 to the valving element recess portion 191. The valving element recess portion 191 allows projection of a portion of the valving element 192 therein and is formed narrow than the valving element chamber 109.

The valving element 192 is mounted to be slidable along the valving element chamber 109 and the valving element recess portion 191. Further, the valving element 192 can selectively assume a closing state where the member 192 projects into the valving element recess portion 191 and an opening state where the member 192 retracts away from the valving element recess portion 191. Further, the valving element 192 is urged to the direction projecting into the valving element recess portion 191 by means of an urging spring 195.

The communication passageway 165 includes a hole portion 197 which cutouts away a portion of the retarded angle passageway 144 communicated with the retarded angle chamber 142 and which communicates the retarded angle chamber 142 and the valving element chamber 109 with each other, and further includes a communication passageway 198 for supplying the operational oil discharged from the valving element chamber 109 to the restricting recess portion 161. Therefore, a portion of the operational oil supplied to the retarded angle chamber 142 is supplied to the restricting recess portion 161 via the hole portion 197, the valving element chamber 109 and the communication passageway 198.

Figure 19:
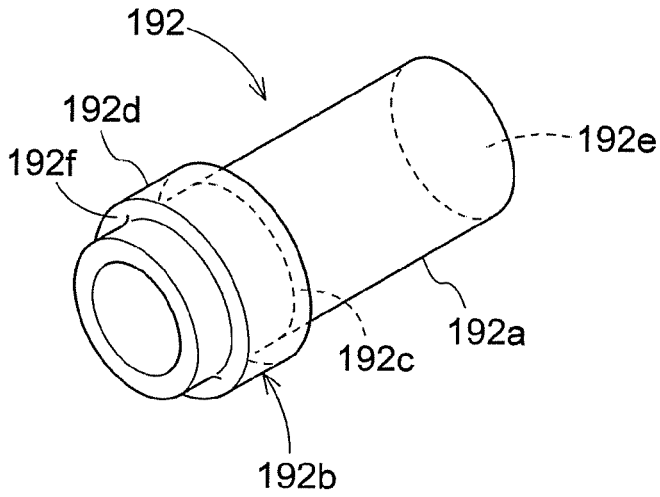
FIG. 19 is an outer appearance view of the valving element of the second embodiment.

The valving element 192, as shown in FIG. 19, has a cylindrical shape conforming to the shape of the valving element recess portion 191 and includes a shaft portion 192*a*, a projecting portion 192*b*, a wall portion 192*c*, an outer face portion 192*d*, an end portion 192*e* and a wall portion 192*f* The projecting portion 192*b* is formed in the outer peripheral face of the shaft portion 192*a* along the valving element recess portion 191. The wall portion 192*c* is a rising face which is a part of the projecting portion 192*b* and which is on the projecting side of the valving element 192 projecting into the valving element recess portion 191. The outer face portion 129*d* is the outer peripheral face of the projecting portion 192*b*. The wall portion 192*f* is a rising face which is a part of the projecting portion 192*b* and which is on the retracting side of the valving element 192 retracting away from the valving element recess portion 191.

The wall portion 192*c* is configured to function as a part of the communication passageway 165 when the valving element 192 is under the opening state. Further, the outer wall 192*d* is configured to close the hole portion 197.

(Leak Passageway)

When the valving element 192 is under the closing state, the outer face 192*d* closes the hole portion 197 and the wall portion 192*f* is located at a position partially opening up the hole portion 197, thus forming a leak passageway L. This leak passageway L is opened to the outside via e.g. a clearance provided between the outer rotor 102 and the inner rotor 103. The leak passageway L allows leakage of fluid from an intermediate passage r1 to the outside, which intermediate passage r1 is formed in the valving element 22 and comprises a part of the space constituting the communication passageway 165 when the valving element 192 is under the closing state, the intermediate passage (r1) being located between the retarded angle chamber 142 which is a valve timing adjusting chamber communicated with the communication passageway 165 and the valving element 192.

As shown in FIG. 18A, under the closing state where the valving element 22 projects into the valving element recess portion 191, the hole portion 197 is closed by the outer face 192*d*. Hence, even if the operational oil is supplied to the retarded angle chamber 142, supply of the operational oil from the retarded angle chamber 142 to the valving element chamber 109 can be prevented. In this, as the leak passageway L is formed, so, even if a part of the operational oil supplied to the retarded angle chamber 142 attempts to leak into the communication passageway 165 through the gap between the outer face 192*d* of the valving element 192 and the hole portion 197, the operational oil can be intentionally caused to leak to the outside, in priority thereto. Therefore, the operational oil does not fill the communication passageway 165 or the restricting recess portion 161. For this reason, there occurs no erroneous movement of the valving element 192 from the closing state to the opening state, such that it is possible to reliably maintain the restricting state where the projecting/retracting member 163 projects into the restricting recess portion 161.

As described above, since the valving element 192 and the valving element chamber 109 are configured such that under the closing state, a portion of the hole portion 197 is displaced from the outer face 197*d*, thus forming the leak passageway L, the leak passageway L can be formed easily. Further, as the construction of this leak passageway L is simple, the leak passageway L can be formed with high precision, so that a portion of the operational oil supplied to the retarded angle chamber 142 is allowed to leak to the outside in even more reliable manner. Therefore, it is possible to restrict displacement of the relative rotational phase even more reliably.

That is, the leak passageway L is provided for allowing intentional leak of the operational oil to the outside with higher priority than the leak of a portion of the operational oil supplied to the retarded angle chamber 142 into the communication passageway 165 through the gap between the outer face 192*d* of the valving element 192 and the hole portion 197. Therefore, the positional relationship between the projecting portion 192*b* and the hole portion 197 is to be set so as to avoid more than necessary leakage of the operational oil.

When the operational oil is supplied to the advanced angle chamber 141, a portion of this operational oil is supplied via the communication passageway 196 to the valving element recess portion 191. Then, as shown in FIG. 18B, due to the pressure of this operational oil, a pressure is exerted to the end portion 192*e* of the valving element 192, whereby the valving element 192 retracts away from the valving element recess portion 191, thus realizing the releasing state. Further, the valving element 192 is urged to the side retracting from the valving element recess portion 191, by the pressure of the operational oil supplied to this valving element recess portion 191, thereby to maintain the opening state. In this, the wall portion 192*f* is not overlapped with the hole portion 197, so that the leak passageway L is not formed.

When the valving element 192 is rendered into the opening state, the space surrounded by the valving element recess portion 191, the shaft portion 192*a* and the wall portion 192*c* functions as a part of the communication passageway 165, thus establishing communication between the hole portion 197 and the communication passageway 198, so that the communication passageway 165 is opened up for communication. Therefore, if the operational oil is supplied to the retarded angle chamber 142, this operational oil is supplied to the restricting recess portion 161 via the hole portion 197 and the communication passageway 165. Therefore, in response to the pressure of this supplied operational oil, the projecting/retracting member 163 retracts away from the restricting recess portion 161, so that the phase displacement restricting mechanism 106 can be rendered to the unrestricting state in a reliable manner.

When the operational oil is charged into the restricting recess portion 161 and the operational oil is charged also in the communication passageway 165 and the valving element chamber 109, the wall portion 192*c* receives the pressure of this operational oil, so that the valving element 192 is urged to the side retracting away from the valving element recess portion 191, thus maintaining the unrestricting state.

In the instant embodiment, the valving element 192 has a shape as shown in FIG. 19. The shape of this element is not limited thereto, as long as the space between the valving element chamber 109 and the valving element 192 forms a part of the communication passageway 165 and the projecting portion 192*b* forms the wall portion of the communication passageway 165 and functions, at the same time, to block the communication between the retarded angle chamber 142 and the communication passageway 165.

For instance, the valving element 192 can be formed such that a face including the wall portion 192*f* constitutes an end face of the valving element 192. In this case too, the positional relationship between the valving element 192 and the hole portion 197 is to be set so as to avoid more than necessary leakage of the operational oil.

Further, the valving element chamber 109, the valving element recess portion 191 and the valving element 192 may be configured to project/retract in the direction normal to the rotational axis of the inner rotor 103 and the outer rotor 102.

(Hydraulic Circuit)

Next, the construction of the hydraulic circuit 107 relating to the present embodiment will be described. This hydraulic circuit 107, as shown in FIG. 12, includes a first pump 171, a second pump 172, and a control valve 173. The first pump 171 is driven by the engine to feed the operational oil. The second pump 172 is driven by a power different from the engine power to feed the operational oil. The control valve 173 is a valve for controlling feeding/discharging of operational oil to/from the fluid pressure chambers 104, the locking mechanism 105 and the phase displacement restricting mechanism 106. This hydraulic circuit 107 corresponds to what is defined herein as the "fluid feeding/discharging mechanism". This hydraulic circuit 107 further includes a control unit 108 for controlling operations of the second pump 172 and the control valve 173.

Here, the first pump 171 is a mechanical hydraulic pump driven as receiving the drive force of the crankshaft of the engine. This first pump 171 draws in, through an intake port, operational oil reserved in an oil pan 174 and discharges this operational oil through a discharge port to the downstream side. The second pump 172 is a pump driven by a power different from the engine power, in this case, this pump 172 is provided as an electrically driven pump driven by an electric motor. Therefore, this second pump 172 can be operated according to operating signals from the control unit 108, regardless of any operational condition of the engine. In operation, this second pump 172 draws in, through an intake port, operational oil reserved in the oil pan 174 and discharges this operational oil through a discharge port to the downstream side.

And, when the engine has started, the first pump 171 is operated for feeling/discharging operational oil to/from the fluid pressure chambers 104 and the phase displacement restricting mechanism 106. Whereas, when the engine is stopped, the second pump 172 is operated for feeding/discharging operational oil to/from the fluid pressure chambers 104 and the phase displacement restricting mechanism 106. Incidentally, when the rotational speed of the engine has dropped, so that the operational oil of sufficient pressure cannot be supplied by the first pump 171, the second pump 172 too may be operated to feed the operational oil, as a matter of course.

(Operations of Valve Timing Control Device)

Next, an exemplary operation of the valving timing control device 101 in the case of starting the engine with setting the relative rotational phase to the predetermined locking phase (most retarded phase). First, under the normal stopped condition of the engine, the first pump 171 and the second pump 172 are stopped, and as shown in FIG. 13, the relative rotational phase is set to the predetermined locking phase (most retarded phase). Under this condition, the phase displacement restricting mechanism 106 is under the restricting state with the projecting/retracting member 163 projected and the valving element 192 is under the closing state.

Under the above condition where the relative rotational phase is restricted within the predetermined range, cranking operation is initiated to start up the engine. Upon this startup of the engine, the control unit 108 renders the control valve 173 into the retarded angle controlling state, so that the operational oil is fed from the hydraulic circuit 107 to the retarded angle passageway 144. As the valving element 192 is under the closing state, the communication passageway 165 is blocked, so no operational oil is fed to the restricting recess portion 161. Therefore, the projecting/retracting member 163 maintains its condition of being projected into the restricting recess portion 161 and the phase displacement restricting mechanism 106 is maintained under the restricting state.

In the above, as the leak passageway L is formed, it is possible to allow a portion of the operational oil to leak to the outside with higher priority than the tendency of the oil portion trying to leak into the communication passageway 165 through the gap between the outer face 192*d* of the valving element 192 and the hole portion 197. Therefore, the operational oil will not fill the communication passageway 165 or the restricting recess portion 161, so no erroneous operation of the valving element 192 from the closing state to the opening state will occur. Thus, the restricting state of the projecting/retracting member 163 projecting into the restricting recess portion 161 may be maintained reliably.

Next, the control unit 108 sets the control valve 173 to the advancing control condition, so that the operational oil is supplied from the hydraulic circuit 107 to the advanced angle passageway 143. With this, as shown in FIG. 14, the relative rotational phase is displaced to the advance direction S1 and also the valving element 192 is retracted from the valving element recess portion 191, thus providing the opening state. Under this condition, since the phase displacement restricting mechanism 106 is still maintained under the restricting state, the lateral face of the projecting/retracting member 163 comes into contact with one end face of the restricting recess portion 161, so that the relative rotational phase is restricted to the intermediate locking phase.

Thereafter, with lapse of a predetermined period, the control unit 108 renders the control valve 173 to the retardation control condition, so that the operational oil is supplied from the hydraulic circuit 107 to the retarded angle passageway 144. Since the valving element 192 is under the opening state, the operational oil is charged into the restricting recess portion 161 through the communication passageway 165 and as shown in FIG. 15, the projecting/retracting member 163 is retracted away from the restricting recess portion 163, so that the phase displacement restricting mechanism 106 assumes the unrestricting state. Therefore, it becomes possible to displace the relative rotational phase as desired within the range between the most retarded phase shown in FIG. 13 and the most advanced phase shown in FIG. 16.

Further, due to some cause, the operational oil might leak into the communication passageway 165 to fill the restricting recess portion 161 and the resultant pressure may render the valving element 192 into the opening state and cause the projecting/retracting member 163 to retract. In consideration to such possibility, there may be provided a leak opening for establishing communication between the restricting recess portion 161 and the outside. With this, even if operational oil flows into the restricting recess portion 161, this operational oil will be caused to leak through this leak opening, to the outside. Therefore, it becomes possible to prevent such retracting movement of the projecting/retracting member 163 inadvertently or due to an erroneous operation of the valving element 192.

Figure 21:
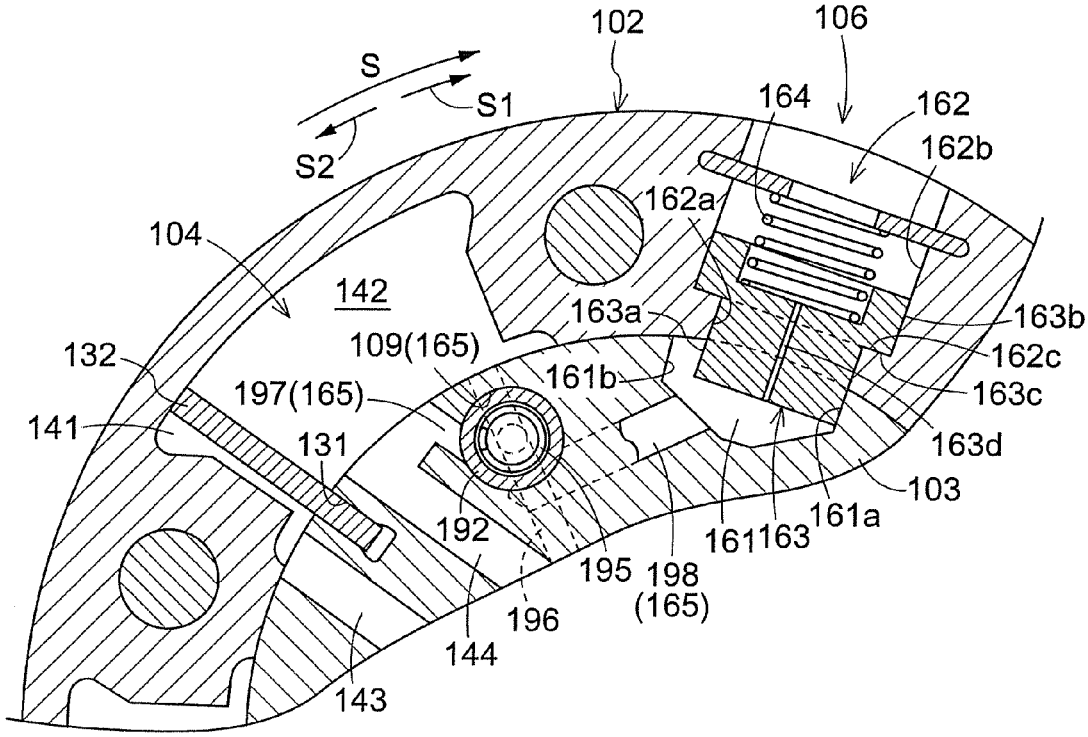
FIG. 21 is an enlarged view showing periphery of an example of the phase displacement restricting mechanism and the valving element chamber when a leak opening is provided in a projecting/retracting member.
Figure 22:
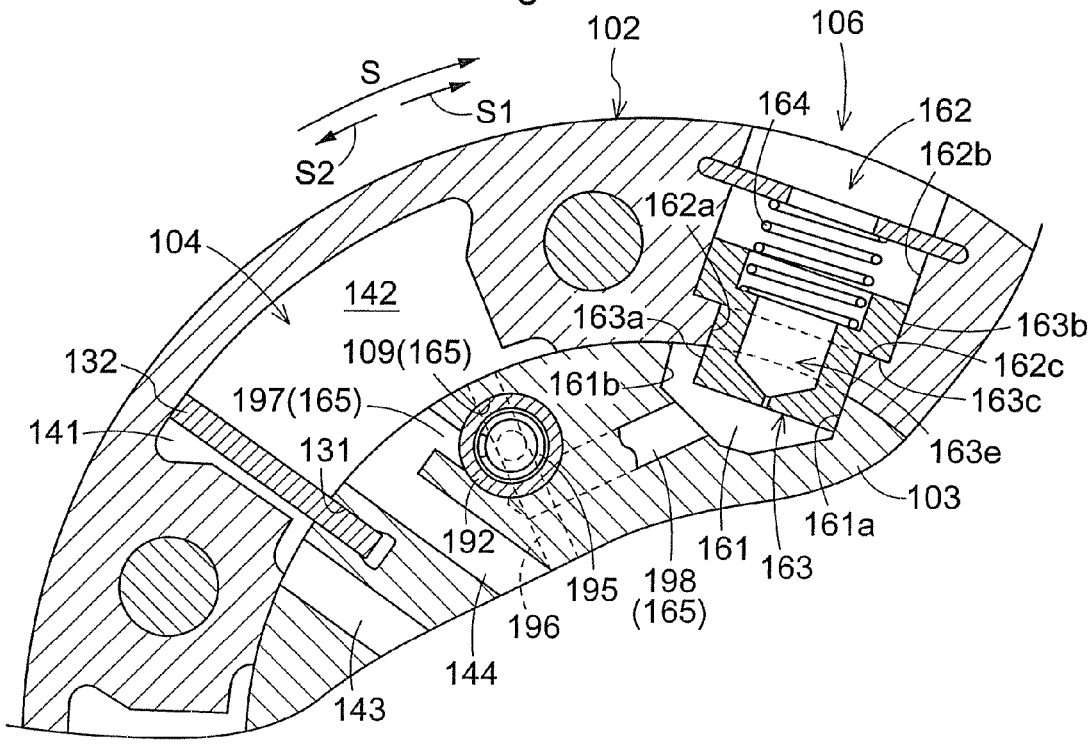
FIG. 22 is an enlarged view showing periphery of a further example of the phase displacement restricting mechanism and the valving element chamber when a leak opening is provided in a projecting/retracting member.

This leak opening can be provided as a through hole 163*d* which extends through the restricting recess portion 161 side of the projecting/retracting member 163 and the outer side, as shown in FIG. 21. Or, as shown in FIG. 22, this can be provided as a through hole 163*e* adapted for allowing smooth leak of operational oil by increasing the width of the outer side of the through hole 163*d*.

However, the leak opening should not have such a shape that allows more than necessary leak of operational oil when the valving element 192 is under the opening state or interferes with the normal projecting/retracting movement of the projecting/retracting member 163.

In the foregoing embodiment, the restricting recess portion 161 is configured to be capable of restricting the relative rotational phase within the predetermined range between the opposed terminal ends defined respectively by the predetermined locking phase and the intermediate locking phase. Instead, the restricting recess portion 161 may be configured so as to be capable of restricting the relative rotational phase to a predetermined position.

Further, the valving timing control device 101 of the present invention may employ a locking mechanism which is provided independently of the phase displacement restricting mechanism 106 and which is capable of restricting the relative rotational phase to a predetermined position.

The valve mechanism consisting of the valving element 192 and the valving element chamber 109 is not limited to the one described above, but can be constructed as shown in a modified embodiment to be described next.

Figure 20:
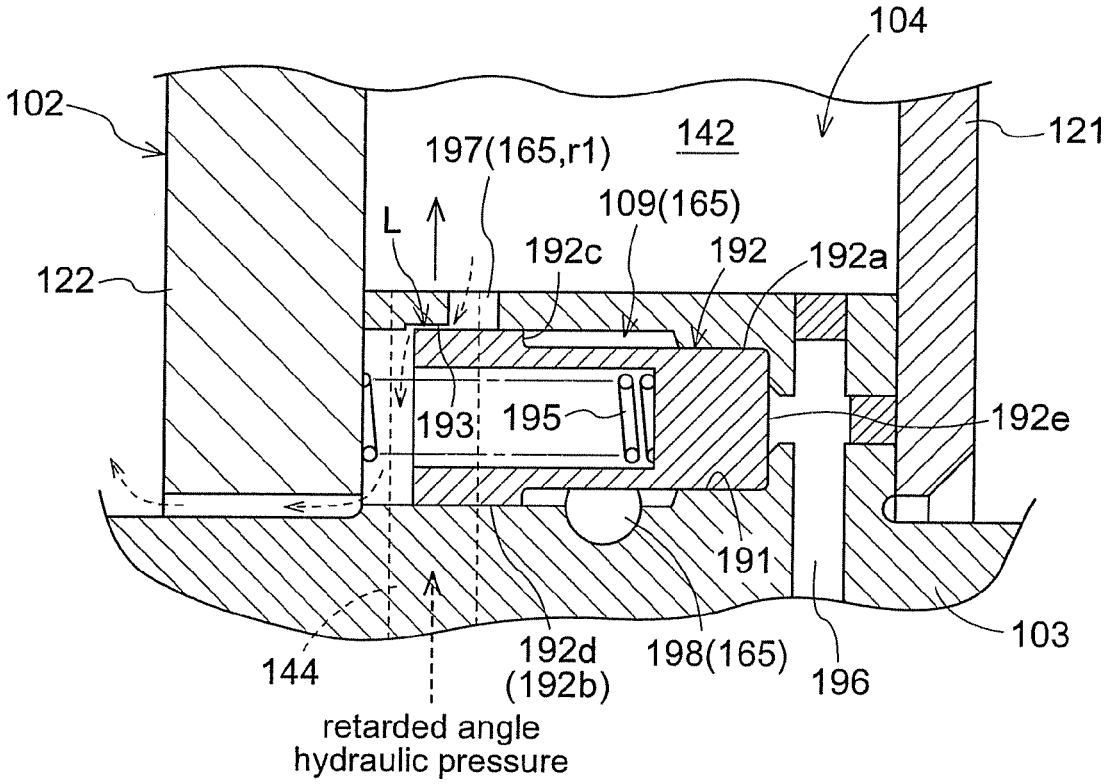
FIG. 20 is a section taken along XVIII-XVIII in a modified embodiment of the valving element of the second embodiment when the valving element is under the closing state.

As shown in FIG. 20, there will be described an embodiment in which the leak passageway L is formed by providing a cutout portion 193 communicating between the hole portion 197 and the outside in the wall portion of the valving element chamber 109. The other arrangements than that relating to the leak passageway L are same as in the foregoing embodiment, therefore, description thereof will be omitted in the following discussion Also, the identical portions or components will be denoted by the identical reference numerals or marks.

The cutout portion 193 is formed by cutting away a portion of the wall portion of the valving element chamber 109 which portion is adjacent the hole portion 197. The cutout portion 193 can be provided in the form of a groove having a fixed width about the valving element chamber 109 or in the form of a recess extending along the perimeter thereof. The valving element 192, as shown in FIG. 20, is formed such that a face thereof including a rising face opposite to the wall portion 192*c* constitutes the end opposite to the end portion 192*e*.

When the valving element 192 is under the closing state, the outer face 192*d* closes the hole portion 197 and at the same time the opposite end is located as a position partially opening up the cutout portion 193, thus forming the leak passageway L. The leak passageway L is opened to the outside through e.g. a clearance provided between the outer rotor 102 and the inner rotor 103. The leak passageway L is formed in the valving element 192 and configured to allow leakage of fluid from an intermediate passage (r1) to the outside, the intermediate passage (r1) comprising a space which constitutes a part of the communication passageway 165 when the valving element 192 is under the closing state and which is located between the retarded angle chamber 142 as the valve timing adjusting chamber communicated with the communication passageway 165 and the valving element 192. When the valving element 192 is under the opening state, the opposite end portion is not overlapped with the hole portion 197, so the leak passageway L is not formed.

In this modified embodiment, the positional relationship between the valving element 192 and the cutout portion 193, the shape of the cutout portion 193 and the depth of the cutout portion 193 are set so as not to allow more than necessary leakage of the operational oil. According to this modified embodiment, even when the valving element 192 is rotationally moved, the leak passageway L is not affected by this movement of the valving element 192. Therefore, a portion of the operational oil fed to the retarded angle chamber 142 can be caused to leak to the outside in a reliable manner. As a result, it is possible to reliably restrict displacement of the relative rotational phase.

Further, the valving element 192 can have a shape as shown in FIG. 19. In this case, the outer face 192*d* closes the hole portion 197 and the wall portion 192*f* is located at a position partially opening up the cutout portion 193, thus forming the leak passageway L.

As various embodiments of the present invention have been described above, according to the present invention, there can be realized a valve timing control device having a phase displacement restricting mechanism which operates in an advantageous manner. However, one skilled in the art could modify the embodiments of the invention without departing from the essential concept thereof defined in the appended claims. Needless to say, such modified embodiments too are intended to be embraced within the scope defined by the claims.

The invention claimed is:

1. A valve timing control device comprising:

a driving side rotational member synchronously rotatable with a crankshaft of an internal combustion engine;

a driven side rotational member coaxial with said driving side rotational member and synchronously rotatable with a valve opening/closing cam shaft of the internal combustion engine;

a fluid pressure chamber formed in one of said driving side rotational member and said driven side rotational member;

a partitioning portion provided in the other of said driving side rotational member and said driven side rotational member for partitioning said fluid pressure chamber into an advanced angle chamber and a retarded angle chamber;

a fluid feeding/discharging mechanism for feeding/discharging fluid to/from said advanced angle chamber and said retarded angle chamber;

a phase displacement restricting mechanism for creating a restricting state where relative rotational phase displacement of said driven side rotational member relative to said driving side rotational member is restricted within a permissible range and an unrestricting state where the restriction is released;

a communication passageway for establishing communication between said phase displacement restricting mechanism and a valve timing adjusting chamber which is one of said advanced angle chamber and said retarded angle chamber;

a valving element chamber provided in said communication passageway;

a valving element provided in said valving element chamber, said valving element selectively positioned to a closing state for closing said communication passageway to render said phase displacement restricting mechanism into said restricting state and an opening state for opening up said communication passageway to render said phase displacement restricting mechanism into said unrestricting state; and a leak passageway formed in at least one of said valving element and said valving element chamber and configured to allow leakage of fluid from an intermediate passage to the outside when said valving element is under the closing state, said intermediate passage comprising a space which is located between said communicated valve timing adjusting chamber or said phase displacement restricting mechanism and said valving element and which constitutes a portion of said communication passageway.

2. The valve timing control device according to claim 1, wherein said leak passageway is provided in said valving element and configured to allow leak of the fluid to the outside through said intermediate passage between said phase displacement restricting mechanism and said valving element when said phase displacement restricting mechanism is under the unrestricting state and said valving element is under the closing state.

3. The valve timing control device according to claim 1, wherein said leak passageway is communicated with said intermediate passage when said valving element is under the closing state, whereas said leak passageway is isolated from said intermediate passage when said valving element is under the opening state.

4. The valve timing control device according to claim 1, wherein said leak passageway comprises a leak through hole provided at an outer peripheral portion of said valving element which is formed as a cylindrical element with one end closed.

5. The valve timing control device according to claim 4, wherein said valving element chamber includes an enlarged diameter portion whose diameter is enlarged to an extent not to contact an outer peripheral portion of the valving element;

when the valving element is under the opening state, the outer peripheral portion of this valving element is in close or gapless contact with the valving element chamber thereby to close the leak through hole; whereas, when the valving element is under the closing state, the leak through hole faces a gap formed between the outer peripheral portion of the valving element and the enlarged diameter portion, thereby to establish communication between the intermediate passage and the outside.

6. The valve timing control device according to claim 1, further comprising:

a cutout groove formed in one of an outer peripheral portion of said valving element which is formed as a cylindrical element with one end closed and said valving element chamber, said cutout groove extending along an operational direction of said valving element;

a projecting rib formed in the other of the outer peripheral portion of said valving element and said valving element chamber and engageable with said cutout groove for allowing movement of said valving element along the operational direction and also preventing rotation of said valving element relative to said valving element chamber; and said leak passageway being formed by a gap between said cutout groove and said projecting rib.

7. The valve timing control device according to claim 1, further comprising a projecting portion provided on an outer peripheral face of the valving element, the projecting portion constituting a wall portion of said communication passageway and blocking said communication passageway at the same time; and wherein said leak passageway is provided between and across said valving element chamber and said valving element so as to allow the fluid to flow to the outside from said valve timing adjusting chamber communicated with said communication passageway when said valving element is under the closing state.

8. The valve timing control device according to claim 7, further comprising a hole portion provided in a wall portion of the valving element chamber to be communicated with the valve timing adjusting chamber communicated with the communication passageway;

wherein an outer face of said projecting portion is capable of closing said hole portion; and said leak passageway is formed by configuring said valving element and said valving element chamber such that when the valving element is under the closing state, a portion of said hole portion is displaced from said outer face, thereby to establish communication between said hole portion and the outside.

9. The valve timing control device according to claim 7, further comprising a hole portion provided in a wall portion of the valving element chamber to be communicated with the valve timing adjusting chamber communicated with the communication passageway;

wherein an outer face of the projecting portion is capable of closing the hole portion; and said leak passageway is formed of a cutout portion provided in a wall portion of the valving element chamber for establishing communication between the hole portion and the outside when the valving element is under the closing state.

* * * * *